US005863301A

United States Patent [19]

Grosso et al.

[11] Patent Number: 5,863,301

[45] Date of Patent: Jan. 26, 1999

[54] METHOD OF PRODUCE LOW VISCOSITY STABLE CRUDE OIL EMULSION

[75] Inventors: Jorge Luis Grosso; Martha Josefina Parra; Omar Caceres; Edelmira Afanador, all of Piedecuesta; Humberto Vidales, Floridablanca; Fabio Enrique Hernandez, Piedecuesta; Rigoberto Barrero, Piedecuesta; Miguel Ruiz, Piedecuesta, all of Colombia

[73] Assignee: Empresa Colombiana de Petroleos ("ECOPETROL"), Bucaramanga, Colombia

[21] Appl. No.: 778,557

[22] Filed: Jan. 3, 1997

Related U.S. Application Data

[63] Continuation-in-part of Ser. No. 253,148, Jun. 2, 1994, abandoned.

[51] Int. Cl.[6] ..... C10L 1/32

[52] U.S. Cl. ..... 44/301; 44/301; 44/302; 137/13; 252/312; 507/937

[58] Field of Search ..... 44/301, 302

[56] References Cited

U.S. PATENT DOCUMENTS

| | | | |
|---|---|---|---|
| 4,757,833 | 7/1988 | Danley | 137/13 |
| 5,000,872 | 3/1991 | Olah | 252/314 |
| 5,013,462 | 5/1991 | Danley | 252/8.554 |
| 5,505,876 | 4/1996 | Rivas et al. | 44/301 |

*Primary Examiner*—Ellen M. McAvoy
*Attorney, Agent, or Firm*—Cooper & Dunham LLP

[57] ABSTRACT

A heavy hydrocarbon, oil-in-water emulsion that has a relatively low viscosity for improved transport is disclosed. The emulsion is produced by combining the heavy hydrocarbon with an aqueous solution of emulsifier with agitation. The emulsifier has an HLB value of about 13 to about 16. The emulsifier can be anionic, nonionic, amphoteric, or a mixture thereof. Stirring is effected at medium shear values of about 0.1 $sec^{-1}$ to about 20 $sec^{-1}$ and at a mixer speed of 50 to 2000 rpm. The mixer imparts sufficient power and shear to the emulsion so that a mean oil droplet size of about 30 $\mu$m is obtained.

23 Claims, 15 Drawing Sheets

INFLUENCE OF TEMPERATURE ON O/W EMULSIONS STABILITY

INFLUENCE OF pH AND EFFECT OF AN EMULSION-BREAKER SURFACTANT ON O/W EMULSIONS STABILITY

METHOD OF PRODUCE LOW VISCOSITY STABLE CRUDE OIL EMULSION

This is a continuation-in-part of application Ser. No. 08/253,148 filed Jun. 2, 1994, now abandoned.

TECHNICAL FIELD

The invention is directed to heavy crude oil emulsions, fuel oil emulsions, and the like, and the preparation thereof. Such emulsions have a substantially uniform oil droplet size, are well suited for transportation of heavy crude through pipelines, and are directly combustible as a fuel.

BACKGROUND OF THE INVENTION

The movement of heavy crude through pipelines is difficult. The pumping of heavy crude, fuel oil, and the like is difficult because of the high viscosity of these materials and their resulting low mobility. A known method in the prior art for transporting these heavy, viscous crudes is the addition of lighter hydrocarbons, etc. to the heavy, viscous crudes by a technique such as distillate blending. This technique is expensive as it requires the addition of expensive, light crudes to transport the heavy, less valuable crude. Also, light crudes are more difficult to obtain than the heavy crudes.

Another known method for the transport of heavy, viscous crude is by heating the crude at frequent intervals along the pipeline. This method requires expensive heating equipment to be installed along the pipeline, and also requires maintenance of this equipment. This method also results in a loss of production that can amount to 15% or more of the crude being transferred, the loss resulting from the crude or other energy source utilized to heat the crude.

Yet another method involves the pumping of viscous hydrocarbon through a pipeline surrounded by a lighter viscosity liquid, such as water. In such cases the pressure drop through the pipeline is substantially that of the lighter viscosity liquid. This method of transportation has several disadvantages, however. The major disadvantage is the loss in core flow stability while being pumped over long distances. Slope changes, pipeline diameter changes, transport through booster or repumping stations, and the like expedients are all detrimental to stability. Also, if flow ceases for any reason, the fluid becomes very difficult to pump when transport is resumed, as the core intermixes with the outer layer once the flow of the fluid is ceased or otherwise interrupted.

The use of emulsions to transport heavy crude is also known in the art. Emulsions are typically prepared by adding a mixture of surfactant, blend of surfactants, stabilizer, corrosion inhibitor, pour point depressor and alkaline or neutral pH water to the heavy crude. However, these prior art emulsions fail to optimally reduce viscosity and improve stability of the emulsion while the emulsion is being transported through the pipeline.

Also, conventional systems prepare the heavy crude oil emulsion by conventional mixing using static or dynamic mixers in addition to other preparation steps. At various stages in such a conventional system, as the emulsion is prepared, the emulsion is first mixed and then pours out of pipes directly into tanks. U.S. Pat. No. 5,000,872 to Olah illustrates such a conventional system in which, for example, the emulsion travels through a static mixer just before pouring into a final emulsion tank at the entry to the transport pipeline. In such a system an opportunity for producing droplets of a uniform size without the need for additional mixers is lost.

Heavy crude emulsions, as well as methods of making such emulsions are disclosed in U.S. Pat. No. 4,618,348 to Hayes et al.; U.S. Pat. No. 4,781,207 to Balzer et al.; U.S. Pat. No. 4,265,264 to Sifferman; and European Patent No. 0 156 486 A2 to Chirinos et al. The emulsifiers utilized in the prior art are numerous. The emulsions in the prior art are manufactured using a variety of mixing conditions and techniques. However, the emulsions of the prior art are difficult to break down into water and oil. Furthermore, the emulsions of the prior art have not been optimized for viscosity and stability to effect efficient transport of these emulsions through pipelines and ultimate utilization.

It has now been found that certain combinations of anionic, nonionic and/or amphoteric emulsifiers, optionally in combination with natural and/or synthetic stabilizers, such as gum, gelatins, carboxymethylcellulose, and the like, when blended at certain shear rates with heavy crude, fuel oil, or the product bottoms from oil barrels, provide an improvement over prior art emulsions. Preparing the emulsions under optimum mixing conditions further enhances their properties. The resulting emulsions form reduced viscosity fluids of controlled stability which fluids can be transported with less effort and which can be utilized more efficiently at the desired destination.

In addition, according to this invention, a diffuser is attached to the end of pipes through which the emulsion must flow to enter an emulsion tank. As the output of the diffuser sprays into the tank droplets of a more uniform and, if desired smaller, size than produced by conventional systems are formed.

SUMMARY OF THE INVENTION

The present invention provides a relatively low viscosity, stable emulsion of heavy, crude hydrocarbons in water, as well as a method for making this emulsion. The heavy crude hydrocarbons are emulsified under shearing conditions and can be heavy crude oil such as Colombian Castilla or Rubiales crude oil, fuel oil with a viscosity of about 50 to about 2,200 Saybolt Furol Seconds (SSF) at 122° F., the product bottoms from oil barrels, paraffinic crudes, direct water-in-oil emulsions, and the like.

An oil-in-water emulsion embodying the present invention is prepared under controlled fluid dynamic parameters and contains approximately 60% to 85%, preferably 70% to 85% by volume of heavy, viscous crude dispersed in approximately 40% to 15%, preferably 30% to 15%, by volume of an aqueous solution of emulsifiers and, optionally, other additives. The emulsion has a substantially uniform particle size, preferably having a sigma ($\sigma$) value of less than about 1.25, and requires less energy for pumping.

The crude oil or heavy crude hydrocarbons can contain relatively large amounts of asphaltenes and metals, and has a specific gravity usually in the range of about 5° API (0.108 Kg/1) to about 30° API (0.676 Kg/1). The emulsifiers can be anionic, nonionic, amphoteric, as well as mixtures thereof. These emulsifiers are present in the produced emulsion at a concentration in the range of about 200 ppm to about 10,000 ppm.

The emulsifiers suitable for making the present emulsion can be anionic emulsifiers such as the sodium alkyl benzene sulfonates, the alkyl sulfonates, the alkyl sulfates, sodium dioctyl sulfosuccinate, and the like. Nonionic emulsifiers such as alkylaryl polyether alcohols, either alone or in combination with the anionic emulsifiers disclosed hereinabove also provide emulsions with the desired properties. Nonionic emulsifiers, if present, are present in an amount of about 0.05% (500 ppm) to about 0.5% (5000 ppm) by volume. Illustrative amphoteric emulsifiers suitable for present purposes are polyethoxyline amine and oxyethylated sodium salts.

A stabilizing agent can optionally be incorporated into the emulsion, especially if the emulsion is to be stored for an extended period of time and/or transported relatively long distances. The stabilizer can be of either natural or synthetic origin. Examples of suitable stabilizers are gums, gelatins and synthetic hydrophilic polymers such as the water-soluble anionic linear polymers, e.g., sodium carboxymethylcellulose.

The salinity of the crude hydrocarbons to be emulsified, and thus of the resulting emulsion, can be as high as 50,000 ppm of sodium chloride (NaCl) at a temperature in the range of about 10° C. (50° F.) to about 60° C. (176° F.). The pH of the emulsion has a value in the range of about 4 to about 13, and is adjusted to this range by the addition of an aqueous solution of an alkali metal hydroxide such as KOH, NaOH and the like, or an alkaline earth metal hydroxide such as $Ca(OH)_2$. Buffering compositions can also be utilized for this purpose in order to enhance the long-term storage stability of the present emulsions.

The method for making the present emulsions requires combining the heavy viscous hydrocarbon, which may contain some water, with water, emulsifier and, optionally, a stabilizing and/or an alkalinity agent at a stirring speed of about 50 rpm to about 2000 rpm, preferably at a speed in the range of about 400 to about 800 rpm. These mixing speeds correspond to shear rates of about 0.1 $sec^{-1}$ to about 20 $sec^{-1}$ at a power input of about 0.1 hp to about 0.75 hp, preferably about 0.1 hp to about 0.5 hp, for every 1000 barrels (1 barrel=42 std. U.S. gallons) of emulsion. At this shear rate and power input per unit volume an oil droplet size of no more than about 40 $\mu$m in at least about 95% of the emulsion volume can be obtained as the agitation is continued.

The method of this invention can be practiced in batch, semi-batch or continuous manner, and is performed by adding small amounts of an emulsifier or group of emulsifiers, with or without an alkalinity agent, to heavy crude oil or other heavy hydrocarbons to be emulsified. The added emulsifiers amount to about 200 ppm by volume to about 10,000 ppm by volume of the emulsion. A stabilizing agent can also be added. Also, emulsions embodying the invention disclosed herein can be prepared from other, previously prepared viscous water-in-oil emulsions. When emulsifiers are added to both the oil phase as well as the aqueous phase, the emulsifiers can be the same or different depending upon the properties of the oil and the desired emulsion. To disperse the oil (the dispersed phase) in the continuous phase (water and emulsifiers, plus, optionally, other ingredients) a mixer adequate to generate a mean droplet size no greater than about 30 $\mu$m and a droplet size of no more than about 40 $\mu$m in at least about 95% of the emulsion, based on volume, preferred.

Another embodiment of this invention employs a diffuser at the end of pipes which feed into emulsion tanks. This diffuser causes the droplets in the emulsion to elongate in such a way that droplets of uniform size are formed in the tank.

One object of this invention is to provide a method for the preparation of an oil-in-water emulsion having the steps of: (1) combining about 60% to about 85% by volume of a hydrocarbon having a specific gravity of about 5° to about 30° API (American Petroleum Institute standard), in about 15% to about 40% by volume of an aqueous solution to form an aqueous hydrocarbon mixture, the aqueous solution comprising water and an emulsifier having a hydrophilic-lipophilic balance (HLB) value of about 13.5 to about 16, the emulsifier comprising an anionic emulsifier and a non-ionic emulsifier; and (2) dispersing the hydrocarbon in the aqueous solution of the aqueous hydrocarbon mixture using agitation at a rate of speed of about 50 to about 2000 revolutions per minute and a shear rate of about 0.1 to about 20 $second^{-1}$ at a power input of about 0.1 to about 0.75 horsepower per 1,000 barrels of the aqueous hydrocarbon mixture for a period of time sufficient to produce an oil-in-water emulsion having a viscosity in the range of 5 to 50 centipoise at 38° C. (100° F.) and stable uniform droplet sizes in the range of 15 to 40 micrometers. Also, this invention includes one or more of the following steps: (1) mixing about 80% to about 99% heavy crude oil or residuals in a temperature range of 100 degrees and 335 degrees Fahrenheit, and about 20% to about 1% of lighter crude oil or diluent (such as a light crude oil having a specific gravity of 18.5 degrees API (American Petroleum Institute standard)) to form the hydrocarbon having a viscosity of about 200,000 centipoise; (2) diffusing the hydrocarbon into the aqueous solution; and/or (3) adding stabilizers to maintain a pH value in the range of about 4 to about 13, the stabilizer selected from the group consisting of: alkali metal hydroxide, hydrochloric acid and alkaline earth metal hydroxide. Furthermore, the agitating step can be continued until at least 95% by volume of the oil-in-water emulsion has an oil droplet size of no more than 40 micrometers and the agitating step can be performed on line using static mixers and/or with a blade-type impeller.

In addition, this invention provides the anionic emulsifier having a concentration of about 200 to about 10,000 parts per million by volume of the oil-in-water emulsion and/or the non-ionic emulsifier having a concentration of about 500 to about 5,000 parts per million by volume of the oil-in-water emulsion. Also, this invention provides that the emulsifier is: (1) nonylphenol exthoxylate having an hydrophilic-lipophilic balance (HLB) value of about 16 and comprising 20 ethylene oxide units per molecule; (2) octylphenol ethoxylate having an hydrophilic-lipophilic balance (HLB) value greater than 13.5; (3) nonylphenol exthoxylate having a hydrophilic-lipophilic balance (HLB) value greater than 13; and/or (4) dioctyl sulfosuccinate having a hydrophilic-lipophilic balance (HLB) value greater than about 13. Also, this invention provides that the aqueous solution includes a stabilizing agent. In addition, this invention provides the diffusing step performed with an atomizer device driven by air impulses.

Another object of this invention is to provide an emulsion having: (1) about 60% to about 85% by volume of a crude oil having a specific gravity from about 5 degrees to about 30 degrees API (American Petroleum Institute standard); and (2) about 40% to about 15% by volume of an aqueous solution comprising water and an emulsifier having a hydrophilic-lipophilic balance (HLB) value of about 13.5 to about 16, the emulsifier comprising anionic and non-ionic emulsifiers having a concentration from about 200 to about 10,000 parts per million by volume of the oil-in-water emulsion, such that the viscosity is in the range from about 5 to 350 centipoise at a temperature of 100 degrees Fahrenheit; and wherein the droplet size is substantially uniform and is no greater than about 40 micrometers. Further, this invention provides for the non-ionic emulsifier having a concentration from about 500 to 5,000 parts per million and/or the anionic emulsifier having a concentration from about 200 to 10,000 parts per million. Also, this invention provides the emulsion including a stabilizing agent. In addition, this invention provides the emulsion having: (1) a dynamic viscosity at ambient temperature of no more than about 50 Pa.s; and/or a particle size distribution having a sigma value of less than about 1.1.

A further object of the invention is to provide a method of producing energy having the step of combusting an emulsion having about 60% to about 85% by volume of a crude oil having a specific gravity from about 5 degrees to about 30 degrees API (American Petroleum Institute standard); and about 40% to about 15% by volume of an aqueous solution comprising water and an emulsifier having a hydrophilic-lipophilic balance (HLB) value of about 13.5 to about 16, the emulsifier comprising an anionic emulsifier and a non-ionic emulsifier and having a concentration from about 200 to about 10,000 parts per million by volume of the oil-in-water emulsion; such that the viscosity is in the range from about 5 to 350 centipoise at a temperature of 100 degrees Fahrenheit; and wherein the droplet size is substantially uniform and is no greater than about 40 micrometers.

A further object of this invention is to provide a device for forming crude oil droplets of substantially uniform size in an emulsion having: (1) an inlet having at least one receiving passage connected to an end of a pipe; (2) a main body connected to the receiving passage for receiving crude oil from the pipe; and (3) a terminator connected to the main body having at least one exit passage, such that oil droplets are elongated by the exit passages so as to form droplets of the substantially uniform size in the emulsion. This invention also provides the main body including a chamber having at least one sidewall passage, such that elongated droplets form by flowing into the chamber through the sidewall passages and out of the exit passage. Also, this invention provides the main body having a cone shape; and the terminator forming a disk at the large end of the cone shape.

DESCRIPTION OF THE PREFERRED EMBODIMENTS

Figure 1:
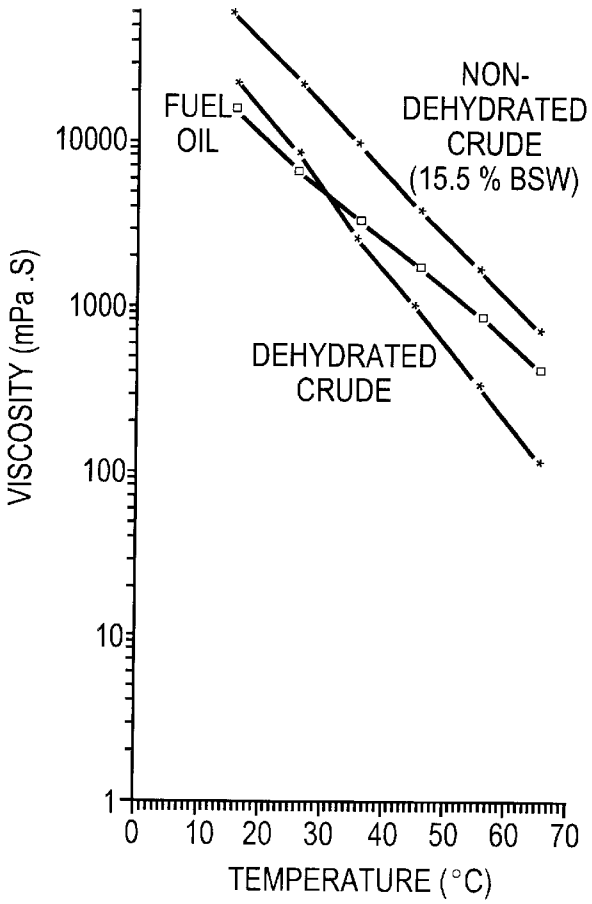
FIG. 1 is a graph showing the effect of temperature on the viscosity of heavy, viscous, dehydrated and non-dehydrated crude oil as well as fuel oil.

Readily pumpable heavy crude oil-in-water emulsions of relatively low viscosity can be prepared under controlled shearing conditions using a variety of emulsifiers having a Hydrophilic-Lipophilic Balance (HLB) value in the range of about 13.5 to about 16.

Emulsifiers can be used either singly or in combination with other emulsifiers of the same family, although having a different HLB value or a mixture of two or more emulsifiers of different compatible families, as long as the HLB value of the combination remains within the aforesaid range. The HLB value of an emulsifier quantifies the relative simultaneous attraction thereof for water and oil It is determined by the chemical composition of the emulsifier and the extent of its ionization. For example, ionic emulsifiers change HLB values radically with a change in pH and/or salt content of an emulsion, whereas non-ionic emulsifiers exhibit a more nearly constant HLB under such circumstances. The emulsifier for practicing the present invention can be either anionic, nonionic, amphoteric or mixtures thereof.

The optimum, and thus preferred, emulsifiers for the emulsions contemplated by the present invention are those which provide optimum viscosity, stability and interfacial tension to the emulsion. The emulsifier is mixed with water. Oil is then combined with the resulting mixture. The optimization of the present emulsions can be carried out using water with a salinity of up to 50,000 ppm and at a temperature of about 10° C. (50° F.) to about 95° C. (200° F.), depending upon the nature of the heavy hydrocarbon to be emulsified and its water content. For a relatively more viscous hydrocarbon the emulsification is effected at a relatively higher temperature. At temperatures lower than 10° C., emulsions of paraffinic crude may produce paraffin crystals which precipitate from the emulsion. This phenomena can be minimized, if desired, by the addition of a pour point depressant to the hydrocarbon prior to emulsification.

Illustrative anionic emulsifiers that impart optimum properties to the emulsion are, for example, the sodium alkyl benzene sulfonates with a molecular weight of about 350 to about 665, the alkyl sulfonates, the alkyl sulfates, and sodium dioctyl sulfosuccinate in an amount in the range of about 200 ppm by volume (0.02 vol. %) to about 10,000 ppm by volume (1 vol. %) of the total emulsion volume. A suitable emulsifier can also be produced by sulfonating fatty acids derived from coffee beans. Typical such fatty acids are constituted primarily by palmitic acid and linoleic acid. An illustrative composition of fatty acids derived from coffee beans that can be sulfonated to produce a suitable emulsifier is as follows:

| | |
|---|---|
| palmitic acid | about 36.4 wt. % |
| stearic acid | about 7.1 wt. % |
| oleic acid | about 7.3 wt. % |
| linoleic acid | about 41.3 wt. % |
| linolenic acid | about 1.3 wt. % |
| arachidic acid | about 2.5 wt. % |

Nonionic emulsifiers such as alkyl aryl polyether alcohols were also found suitable for the emulsions disclosed herein. Such emulsifiers are prepared by reaction of octylphenol or nonylphenol with ethylene oxide. The nonionic emulsifiers can be utilized in an amount of about 500 ppm by volume (0.05 vol. %) to about 5000 ppm by volume (0.5 vol. %) of the total emulsion volume.

A mixture of the anionic emulsifiers and nonionic emulsifiers is also contemplated as useful in the present emulsions. The mixture of anionic and nonionic emulsifiers exhibits greater salinity tolerance, which is useful if the water used to prepare the emulsion has a significant saline concentration. The respective weight ratios of anionic-to-nonionic emulsifiers in such mixtures can be in the range of about 30:70 to about 80:20. This weight ratio can be readily optimized for a particular crude by routine experimentation.

Amphoteric emulsifiers such as the polyethxyline amines, oxyethylated sodium salts containing both anionic and cationic centers, and the like, are also suitable for the practicing of this invention.

A stabilizing agent can be combined with the emulsifier to stabilize the emulsion. The stabilizer can be of natural or synthetic origin.

The stabilizers of natural origin are exemplified by water-soluble gums, i.e., complex carbohydrates that yield sugars on hydrolysis, such as gum arabic, the carrageenans, locust bean gum, and the like. Particularly preferred are the arabian type gums such as gum arabic (derived from *Acacia senegal*), and the like. Also suitable are gum ghatti (derived from *Anogeissus latifolia*), gum karaya (derived from *Sterculia urens*), and the like.

The stabilizers of synthetic origin can be natural based such as the water-soluble anionic linear polymers exemplified by sodium carboxymethylcellulose, or petroleum-based such as the polymerized vinyl-type monomers modified to contain acidic function and exemplified by polyacrylic acid and the derivatives thereof, e.g., polyacrylic acid polymers lightly cross-linked with a polyalkenyl polyether and commercially available under the designation CARBOPOL™. Also suitable are the polyvinylpyrrolidones, carboxyvinyl polymers, and mixtures of the foregoing.

The emulsions herein described can be prepared using either heavy crude oils, the bottom product from oil barrels, paraffin crudes and medium and light crude oils. Heavy crudes such as the Colombia Castilla or the Rubiales crude oil, and fuel oils with a viscosity of about 50 to about 2200 SSF (122° F.), when emulsified according to this invention, are transported and utilized with greater efficiency. The disclosed method is particularly effective for preparing a High Internal Phase Ratio (HIPR) emulsion using heavy, viscous crudes that potentially contain large amounts of asphaltenes and metals with a specific gravity (60/60) between about 5° API (0.108 Kg/1) and 30° API (0.676 Kg/1). If desired, the heavy crude can be diluted with a lighter hydrocarbon, e.g., light cycle oil (about 18.5° API) to a viscosity of about 200,000 cPs (200 Pa.S) prior to emulsification.

In order to properly assess the process disclosed herein, emulsions were prepared using medium crudes (22°–30° API), heavy crudes (14°–21° API) and extra heavy crudes with an API density less than 14° API. The heavy crudes comprise 60% to 85% by volume of the emulsion, preferably 70% to 85% by volume.

Emulsions with a higher oil content are more economical to transport because more oil is transferred per unit volume of emulsion. The viscosity of the emulsion increases with higher crude oil content, however, and losses due to increased viscosity preclude increasing the oil content of the emulsion above a certain level.

Work is required to disperse the oil droplets in the continuous (aqueous) phase. By breaking the dispersed phase into droplets, more surface area of the dispersed phase is exposed to the continuous phase. The type of mixing equipment used also affects the nature of the produced emulsion. The degree or time of agitation, the type stirrer, the speed or the shear rate, and also the process type (i.e., batch, semibatch or continuous) and whether the process is static or dynamic, influences the type of emulsion that results. Generally a suitable mixer is one that effectively disperses a high viscosity fluid (heavy crude) in a lower viscosity solution (water plus emulsifier and other ingredients).

Impellers of the blade-type are suited for use in conjunction with the mixing equipment used to effect the desired dispersion of the oil phase into the aqueous phase. Flat blade, disc flat blade, curved blade and pitched blade impellers all perform effectively at a rotational speed of about 50 to about 2000 rpm. This is equivalent to a shear rate of about 0.1 $sec^{-1}$ to about 20 $sec^{-1}$ at a power input of about 0.1 hp to about 0.75 hp, preferably about 0.1 hp to about 0.5 hp, per 1000 barrels of the emulsion. Forty-two standard U.S. gallons equal one barrel. The preferred impellers are those that have a relatively high discharge capacity with a relatively low head when used with a mixture that is about 60% to 85% by volume heavy, viscous hydrocarbon and about 30 to 15 volume percent water and other additives at a stirring speed of 50 to 200 rpm, preferably 400 to 800 rpm.

The impeller diameter-to-tank diameter ratio also impacts the emulsion properties. A ratio of about 0.5 to about 0.4 for impeller diameter-to-tank diameters is preferred. The ratio of liquid column height to tank diameter can also impact emulsion properties. A column height-to-tank diameter ratio of about 0.9 to about 0.5 is preferred.

The selected emulsifiers are combined with water and the resulting aqueous admixture amounts to 15% to 40%, preferably 15% to 30%, of the total emulsion volume. The crude oil is then mixed with the aqueous admixture using an agitator as described herein, preferably at about 400 to 800 rpm. Alternatively, emulsification can be achieved using a static mixer or an air-driven atomizer.

The heavy, viscous crude oil is dispersed in the admixture of water and emulsifier at a temperature of about 4° C. (40° F.) to about 82° C. (180° F.), preferably at a temperature of about 50° C. (122° F.) to about 60° C. (140° F).

Higher temperatures and pressures, e.g., 100° C. (212° F.) to about 168° C. (335° F.) at superatmospheric pressures up to about 200 psia, can be utilized as well during emulsification.

The water may be fresh or saline water with a salt concentration of up to about 50,000 ppm by volume. The dynamic viscosity of the produced emulsions is about 5 cPs (0.005 Pa.S) to about 350 cPs (0.35 Pa.S) at 38° C. (100° F.), preferably about 5 cPs to about 50 cPs (0.05 Pa.S), depending upon the starting materials. (1 cP=0.001 Pa.S=1 mPa.s)

The emulsions described herein can also be prepared starting with a water-in-oil emulsion having a dynamic viscosity of about 2,000 cPs (2 Pa.S) to about 300,000 cPs (300 Pa.S). The water-in-oil emulsion contains about 5% to about 20% volume percent water. The emulsifier and additional water are added to the water-in-oil emulsion in amounts sufficient to produce the oil-in-water emulsion herein described.

The pH of the emulsion may vary from about 4 to about 13. Alkaline solutions of hydroxides of alkali metals, e.g. potassium and sodium, or an alkaline earth metal such as calcium, can be added to the emulsion to adjust the pH to within this range if necessary. Similarly, hydrochloric acid can be added to lower the pH to a value within the above range, if necessary. The saline concentration of the emulsifier solution preferably is no more than about 50 ppm, by weight, but can be as high as 50,000 ppm.

When a paraffinic crude with a relatively high pour point of about 15.5°–26.7° C. (60°–80° F.) is emulsified in accordance with the process disclosed herein, the pour point is lowered. This provides an improved flow of the crude at relatively lower temperatures when the crude is emulsified according to the disclosed process. The paraffinic crudes exhibit a relatively lower viscosity when emulsified according to the disclosed process. A pour point modifier can be added to the emulsion to raise or lower the pour point, if desired. Suitable pour point modifiers are ethylene interpolymers, ethylene-vinyl acetate copolymers, polyacrylate copolymers, and the like, in an aromatic liquid vehicle such as the xylenes, toluene, and the like.

The flow characteristics of the produced emulsion also depend on whether this emulsion is a Newtonian or non-Newtonian fluid. An emulsion that exhibits Newtonian behavior is preferred because Newtonian fluids maintain a constant viscosity over a broad range of shear rates and, thus are more stable under different flow conditions. In non-Newtonian fluids, on the other hand, viscosity varies with the shear rate and non-Newtonian emulsions are less stable under different flow conditions.

The shearing conditions contemplated by the present method as disclosed herein minimize the interfacial tension between the oil and water phases in the emulsion. This, in turn, minimizes the viscosity of the emulsion, thereby enhancing its flow characteristics and reducing power requirements for pumping. The lower the interfacial tension, the lower the droplet-to-droplet interaction. This is so because the droplets elongate more easily along stream-flow lines rather than colliding with one another and creating resistance to flow. Because of the low interfacial tension and low viscosity of the emulsion, a relatively narrower droplet size distribution is achieved. Thus, the mean droplet size can be more easily regulated. A mean droplet size of less than about 30 $\mu$m provides the desired Newtonian flow characteristics to this emulsion. Preferably, the mean droplets size is less than about 20 $\mu$m, oil droplets about 40 $\mu$m or less in diameter are present in at least about 95% of the emulsion disclosed herein. The desired droplet size can be achieved by optimizing the fluid-mechanical parameters such as agitator speed, agitation time, agitator type, etc. as disclosed herein. The sigma ($\sigma$) value of the present emulsions, a measure of particle size distribution, preferably is less than about 1.25, more preferably no more than about 1.1.

The emulsion disclosed herein also exhibits improved pumpability, combustion characteristics and dehydration properties over heavy, viscous hydrocarbon oil-in-water emulsions in the prior art. The emulsifiers used in the formulation have optimum affinity for the aqueous phase, thereby imparting improved properties to the emulsion. The heating value of the present emulsions preferably is at least about 13,000 BTU/pound.

Maximizing the solubility of oil and water into one another by using the proper emulsifier produces an emulsion with the desired properties. Furthermore, by adjusting the emulsifier composition, one can tailor an emulsion for particular use; highly stable emulsions if they will be stored in tankers for a great length of time; emulsions that are easily resolved into their components if the end use so dictates; and emulsions that can be directly combusted if phase separation is not required.

The emulsions prepared according to the above-described process usually exhibit a pH value in the range of about 4 to about 13. Emulsions exhibiting a pH value of about 7 to about 10 are more stable, but can be readily broken down, i.e. separated into oil and water components, when desired, by acidification to a pH value of less than about 7, usually a pH value in the range of about 4 up to 7. A deemulsifying agent such as polyethoxyalkylamine can also be used for this purpose. The heavy crude separated from the emulsion has a water content of about 0.5% by volume. The water separated from the crude usually contains approximately 0.001% to about 0.003% (10–30 ppm) by volume of heavy crude oil, but can contain up to about 0.005% (50 ppm) by volume of heavy crude oil.

The emulsions disclosed herein can be broken down and the dispersed and continuous phases thereof separated using a chemical method in which the pH of the emulsion is changed from basic to acidic or vice-versa depending upon its initial pH. Surface active agents that modify the hydrophilic nature of the emulsifier system that is present are also useful to break down these emulsions. Neutralization of the hydrophilic forces, or their eliminations, eliminates the major forces that keep the emulsions stable. Thus, the emulsions are easier to break down. With the emulsifiers used herein, the separation of the oil and water phases of the emulsion is readily achieved by lowering the pH value of the emulsion.

The following examples are evaluations of the emulsions disclosed herein and made according to the method of this invention. Various properties of emulsions made with different emulsifiers at different concentrations and different oil-to-water ratios were evaluated to determined the optimum emulsion properties for the various contemplated applications. The effect of different mixing or stirring parameters was evaluated to determine the optimum conditions needed to prepare the desired emulsions. These examples are made by way of illustration only to highlight the more general discussion of the inventive concepts discussed hereinabove and the claims appended hereto.

Several viscous crude oils were used to evaluate the efficacy of the process disclosed herein. The crudes used where obtained from the oil fields of Colombia, which yield some of the most viscous, difficult-to-transport crudes similar to the Venezuelan and Canadian crudes. A summary of the characteristics of the crude oil used in these examples is found in Table I hereinbelow. The properties of the crude oils evaluated in Table I were determined using ASTM Standards D-97, D-287, D-96 and D-3230-13.

TABLE A

Colombian Castilla Heavy Crude Oil Characteristics

| Characteristic | Non-Dehydrated Crude Oil (BS&W = 15.6%) | Dehydrated Crude Oil BS&W = 0.5%) |
|---|---|---|
| API Density (60° F.) | 12.6 | 13 |
| Specific Gravity (60/60) | 0.982 | 0.9792 |
| Density (Kg/1 @ 15° C.) | 0.9814 | 0.9787 |
| Pour Point (°C.) | 4° C. | 0.3° C. |
| Salinity (PTB) | 100 | — |
| Viscosity (cP) @ (25° C.) | 15,189 | 7,530 |
| Viscosity (cP) @ (55° C.) | 1,195 | 408 |

BS&W = basic sediment and water

EXAMPLE 1

Effect of Temperature on Emulsion Viscosity

The viscosity of the crude oils used in the present examples was determined using CV100 and RV20 Haake concentric viscometers at different temperatures, and recorded. The data are presented in FIG. 1. As can be observed from FIG. 1, the viscosity of the crude is dramatically reduced by an increase in the temperature. The effect of temperatures on the crude oil viscosity is slightly more pronounced when the crude is hydrated.

EXAMPLE 2

Effect of Different Emulsifiers on Emulsions

Several emulsions were prepared using different emulsifiers. Emulsifiers with HLB values of about 13.5 to about 16 were utilized in these emulsions. These emulsions were prepared by adding the viscous hydrocarbon to water and emulsifier combination. The mixtures were all agitated mechanically at a speed of 600 rpm. The resulting emulsions were 75% by volume oil and 25% by volume water.

Figure 2:
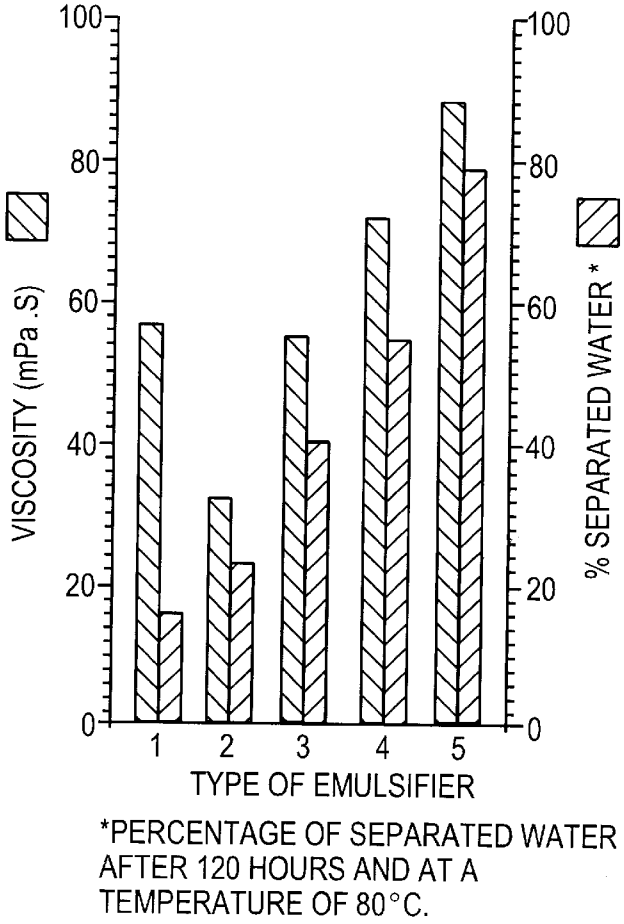
FIG. 2, illustrates the effect of different emulsifiers on viscosity and stability of heavy crude oil-in-water emulsions.
Figure 3:
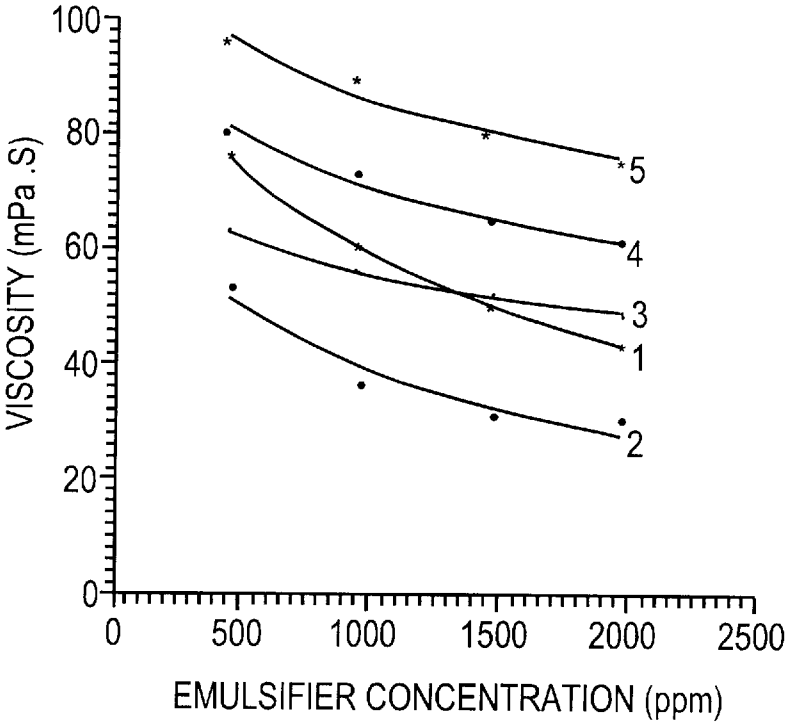
FIG. 3 illustrates the effect of emulsifier concentration on viscosity of heavy crude-oil-in-water emulsions.

FIG. 2 and FIG. 3 illustrate the properties of the emulsions that were prepared using emulsifiers of various HLB values. The emulsions formed had relatively good stability. An emulsion exhibits good stability by remaining in its emulsified state, rather than the dispersed and continuous phase separating completely. The emulsion with a mixture of an anionic emulsifier, sodium sulfosuccinate, and nonionic emulsifier, nonylphenol ethoxylate, (HLB>13) exhibited the greatest stability of the emulsions tested. FIG. 2 illustrates the stability of the emulsions of the oil-in-water emulsions as indicated by the amount of water that separate from the emulsions after 120 hours at a temperature of 80° C. (176° F.). The emulsifiers used in these emulsions are enumerated in the Table II below.

TABLE II

Emulsifiers Tested

| N | Family | Emulsifier | HLB |
|---|---|---|---|
| 1 | Nonionic | Nonylphenol ethoxylate | 16 |
| 2 | Anionic + Nonionic | A 30 wt % Anionic/70 Wt % Nonionic Mixture | >13 |
| 3 | Anionic | Dioctyl sulfosuccinate | >13 |
| 4 | Nonionic | Nonylphenol ethoxylate | 13.5 |
| 5 | Nonionic | Octylphenol ethoxylate | 13.5 |

Nonionic surfactants with HLB values of 13.5 produced the least stable emulsions while the emulsion formed with the anionic/nonionic emulsifier mixture had a relatively greater stability.

FIG. 3 illustrates the effect of the various emulsifiers from Table II on the viscosity of the emulsions prepared therewith. As is apparent from FIG. 3, most of the viscosity reduction is achieved at emulsifier concentrations of about 550 ppm to 1500 ppm by volume, regardless of the emulsifier used. The emulsifiers tested were those enumerated in Table II above.

At emulsifier concentrations is excess of 2000 ppm, the reduction in viscosity that is obtained is seldom justified by the additional expense of the increased amount of emulsifier used. Furthermore, the fluid dynamics of the agitation provide stability to the emulsion, thereby reducing the need for larger amount of emulsifiers.

EXAMPLE 3

Effect of Emulsifier Concentration on the Emulsion Droplet Size

Figure 4:
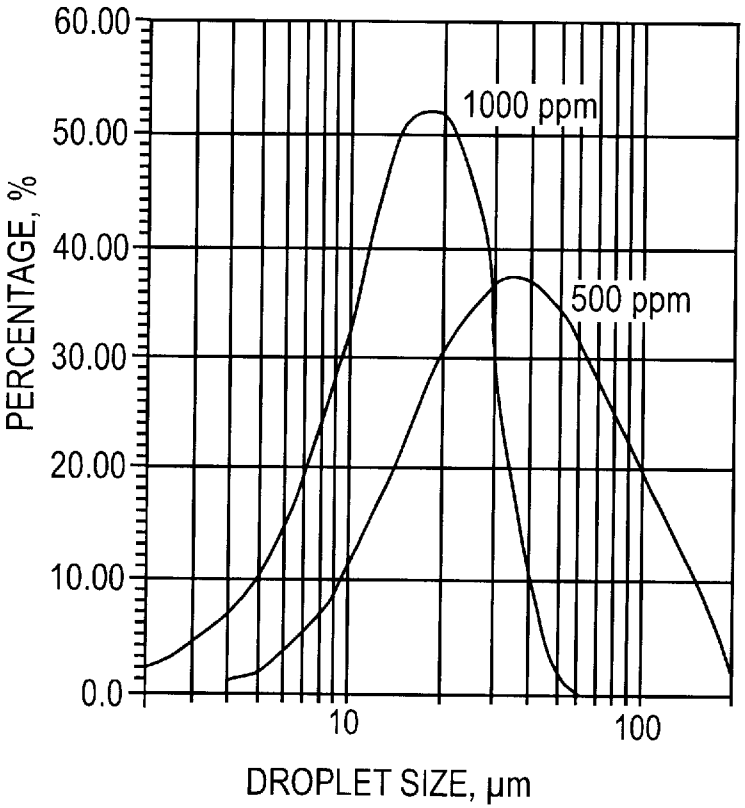
FIG. 4 illustrates the effect of emulsifier concentration on droplet size and droplet size distribution of heavy crude oil-in-water emulsions.

Emulsions were prepared that contained crude oil (70% by volume), water, and emulsifier. The emulsion temperature was 25° C. (77° F.). An anionic emulsifier, dioctyl sulfosuccinate, was utilized in the emulsions. Two emulsions were prepared of similar composition; one with an emulsifier concentration of 500 ppm (by volume) and one with a concentration of 1,000 ppm (by volume). FIG. 4 illustrates the effect of emulsifier concentration on droplet size distribution. An emulsifier concentration of 0.1% by volume (1000 ppm) yielded a preferred mean droplet size of less than about 30 $\mu$m.

Figure 5:
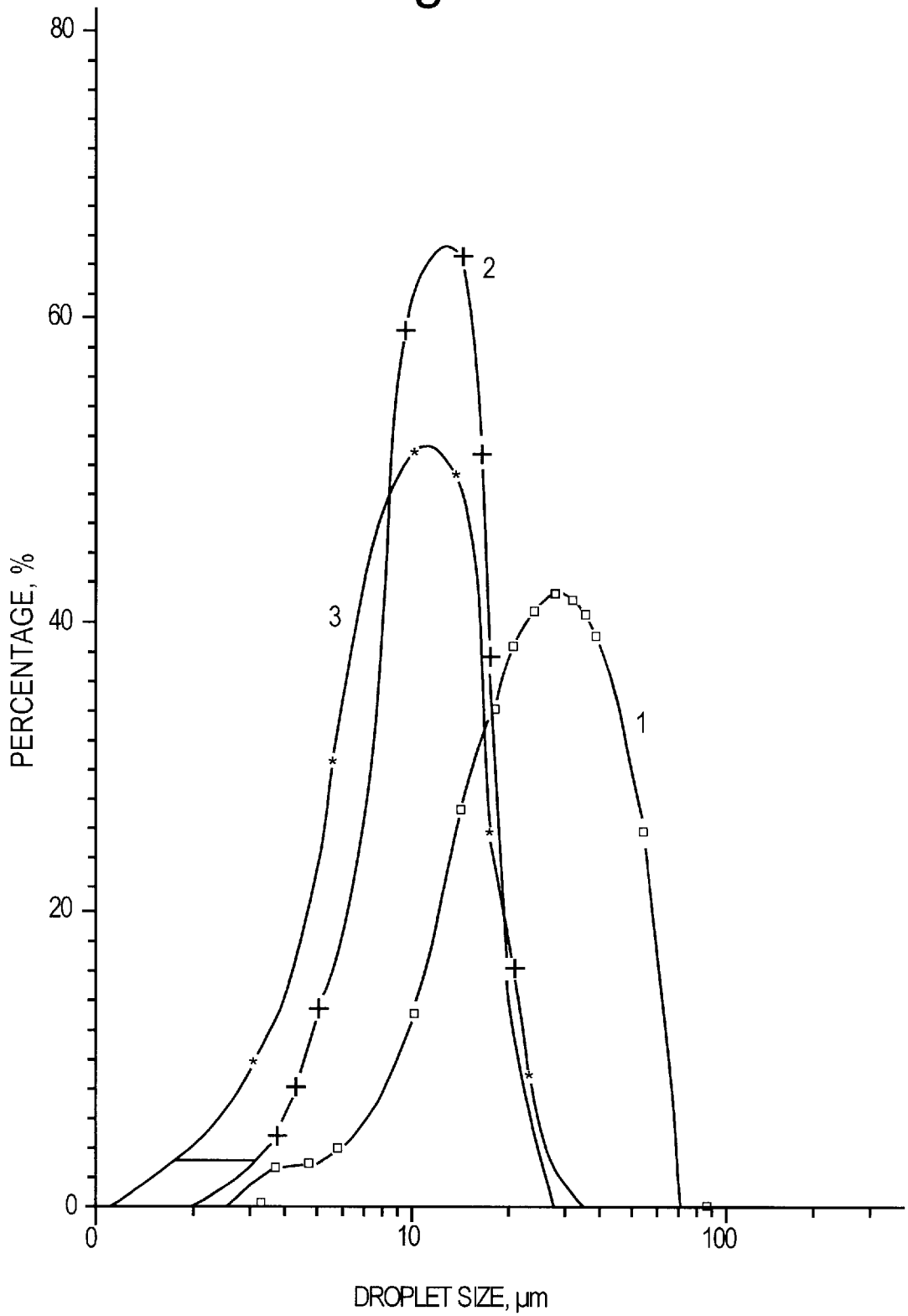
FIG. 5 illustrates the effect of different types of emulsifiers on droplet size and droplet size distribution in heavy crude oil-in-water emulsion.

Heavy crude oil-in-water emulsions were prepared with 70% heavy crude and various emulsifiers, all with an HLB greater than 13 at a concentration of 0.08% (800 ppm) by volume. The mean oil droplet size of the emulsions was determined. FIG. 5 illustrates that all of the emulsifiers provide an acceptable mean droplet size of about 30 $\mu$m or less to the emulsion. The emulsifiers tested were Emulsifiers 1–3 from Table II above. An emulsifier that is a mixture of anionic and nonionic emulsifiers yielded a preferred droplet size of about 10 $\mu$m with a narrower range of droplet size distribution.

EXAMPLE 4

Effect of Oil Phase Concentration on Emulsion Viscosity

Figure 6:
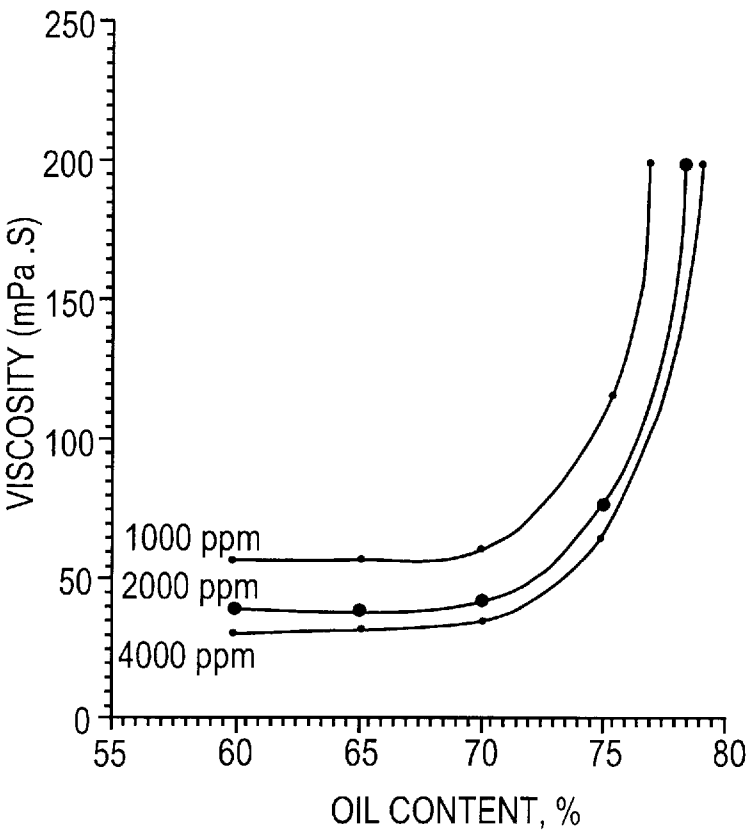
FIG. 6 illustrates the effect of oil phase concentration on the viscosity of an oil-in-water emulsion at different emulsifier concentrations.

Emulsions were prepared according to the process disclosed herein using a nonionic, nonylethoxylate type emulsifier with an HLB of 16. There were approximately 20 ethylene oxide units per molecule in the emulsifier. The percent of heavy, viscous crude oil in the emulsion was varied at different emulsifier concentrations. The crude oil used in the emulsions had a viscosity of 15,500 cPs (15.5 Pa.S). A propeller type agitator at a speed of 600 rpm was used to stir the emulsion. The observed viscosities are presented in FIG. 6 which illustrates that the viscosity of the emulsions is very low when the percentage of viscous crude oil in the emulsion is below about 75% by volume, regardless of emulsifier concentration, at an emulsifier temperature of 25° C. (77° F.).

Figure 7:
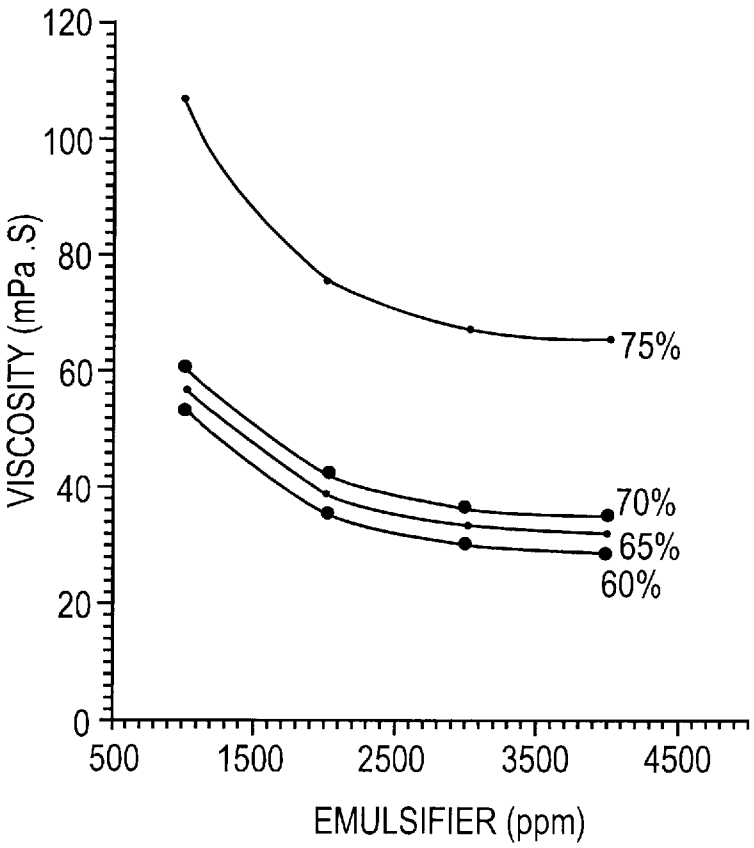
FIG. 7 illustrates the effect of emulsifier concentration on the viscosity of an oil-in-water emulsion at various oil concentrations.

The data from the same experiments and presented in FIG. 7 illustrate that emulsifier concentrations greater than 3000 ppm by volume do not further reduce the emulsion viscosity to a significant extent regardless of the volume of heavy crude in the emulsion.

EXAMPLE 5

Effect of Stirring Speed on Emulsion

Figure 8:
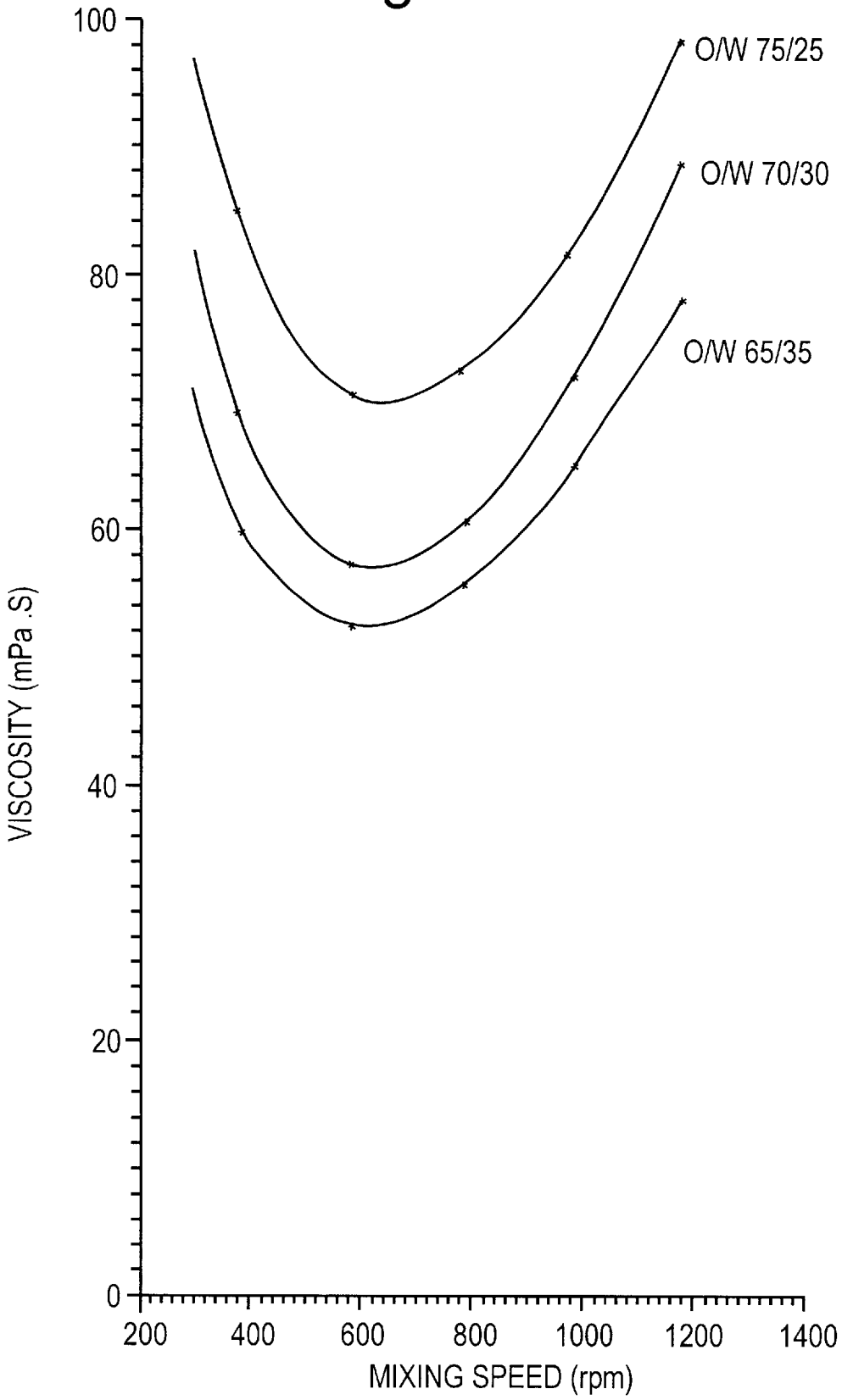
FIG. 8 illustrates the effect of mixing speed on the viscosity of oil-in-water emulsions with different oil/water ratios.

Emulsions of a crude oil with a viscosity of about 15,000 cP to about 100,000 cP and a water solution of a nonylphenol ethoxylate, a nonionic emulsifier (HLB=13.5), were prepared. The stirring speed was varied for emulsions with oil-in-water concentration ratios (O/W) of 75/25, 70/30 and 65/35. The higher water content emulsions had a lower viscosity. For the various concentrations of oil in water, a stirring speed of about 600 rpm produced the emulsions of lowest viscosity. The emulsions made a stirring speeds of greater than 1000 rpm had noticeably higher viscosity. These results are illustrated in FIG. 8.

EXAMPLE 6

Effect of Stirring Parameters on Emulsion Viscosity

Figure 9:
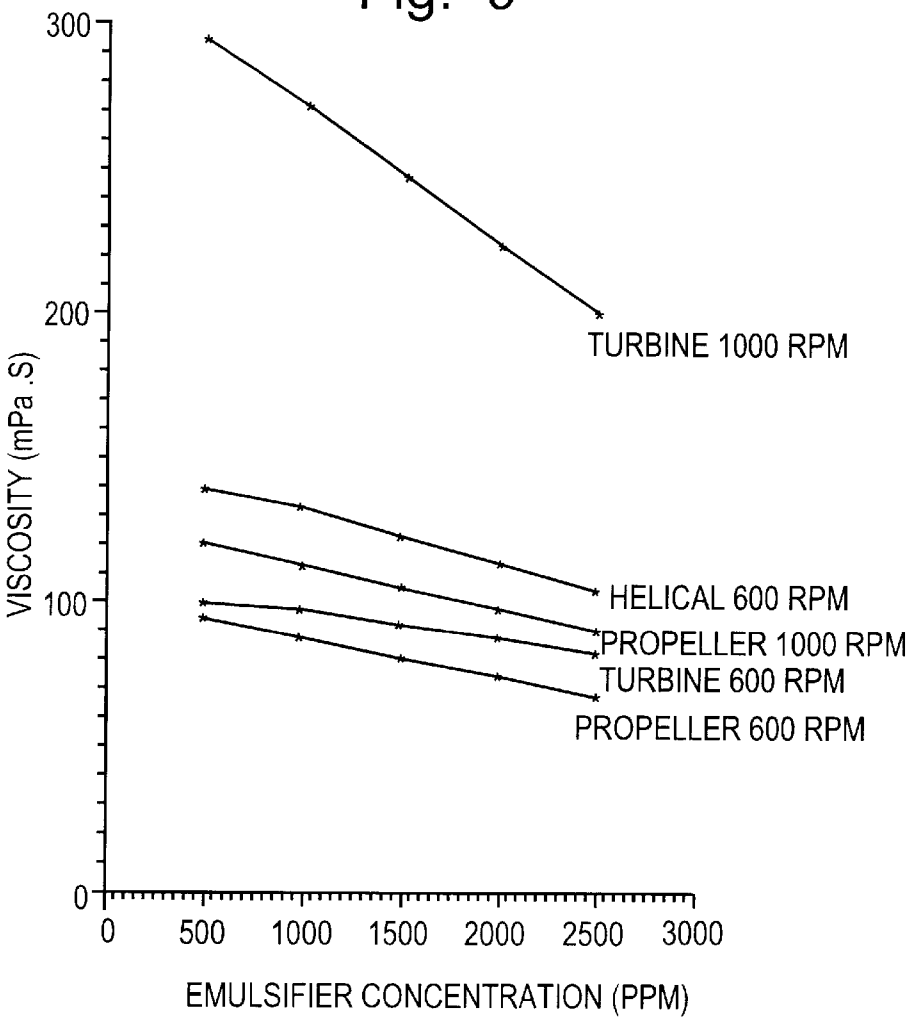
FIG. 9 illustrates the effect of emulsifier concentration on the viscosity of emulsions using various mixers and various mixing speeds.

Emulsions with an O/W ratio of about 70/30 were prepared using various stirrers with various impellers. The emulsifier used was nonylphenol ethoxylate, a nonionic emulsifier (HLB=13.5). The effect of emulsifier concentration on the viscosity of these emulsions was observed. The results appear in FIG. 9. The percent decrease in viscosity observed when the emulsifier concentration was increased from 500 ppm to 2500 ppm by volume was less than the percent decrease in viscosity observed when the mixer was changed from a helical-type at 600 rpm to a propeller-type impeller at 600 rpm. Thus, at a given emulsifier concentration, the type of impeller used and the speed at which it rotates have a demonstrated effect on the emulsions viscosity.

Furthermore, the differences in viscosity of emulsions prepared using the different type impellers and stirring speeds at a given emulsifier concentration are somewhat uniform over a wide range of viscosities. This indicates that the effect of stirring conditions on the emulsion is somewhat independent of emulsifier concentration.

EXAMPLE 7

Effect of Stirring Time on Emulsion Viscosity

Emulsions were prepared with an O/W ratio of 70/30 by volume at a temperature of 25° C. (77° F.). The emulsifier concentration was 0.1% by volume (1000 ppm). Emulsifiers 1–4 from Table II were used to formulate the emulsions, all with HLB values of about 13.5 or greater. The stirring speed was 400 rpm.

Figure 10:
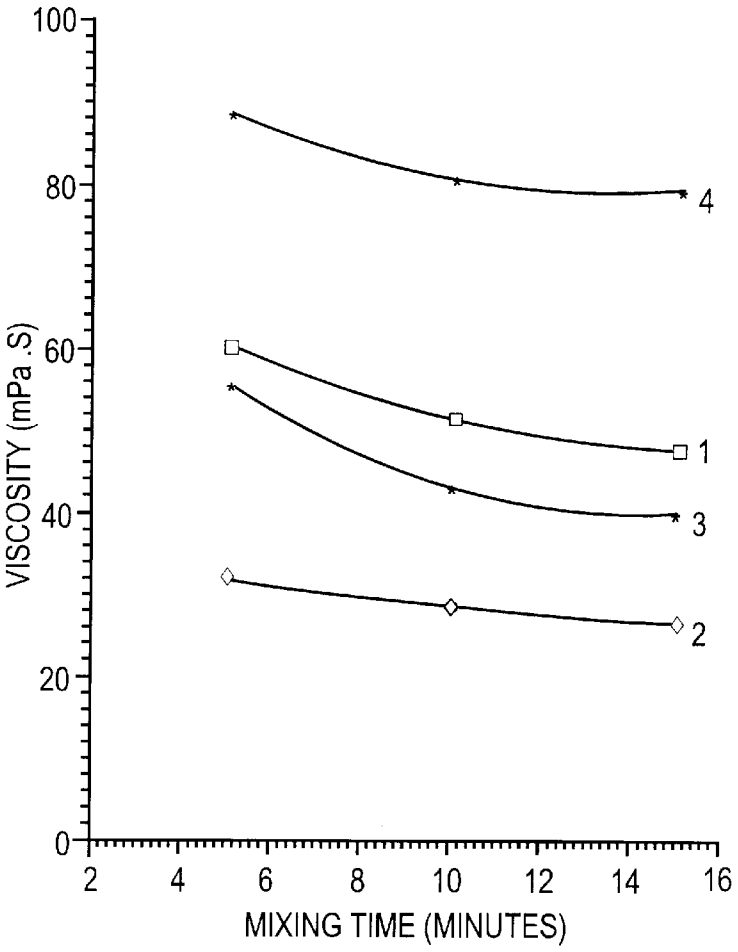
FIG. 10 illustrates the effect of mixing time on the viscosity of oil-in-water emulsions using various emulsifiers.

FIG. 10 illustrates the effect of stirring time on the viscosity of these emulsions. It appears that stirring time in excess of 10 minutes results in very little additional viscosity reduction. The anionic emulsifiers and the mixtures of anionic and nonionic emulsifiers with relatively high HLB values yielded emulsions with the lowest viscosity regardless of stirring time.

EXAMPLE 8

Effect of Stirring Speed on Emulsion Viscosity

Heavy crude oil-in-water emulsions (70% by volume oil) were prepared. In order to evaluate the effect of stirring speed on viscosity and droplet size distribution, the emulsions were prepared at various mixing speeds and using various kinds of emulsifiers (Emulsifiers 1, 4 and 5 from Table II) at a concentration of 0.1. by volume (1000 ppm).

Figure 11:
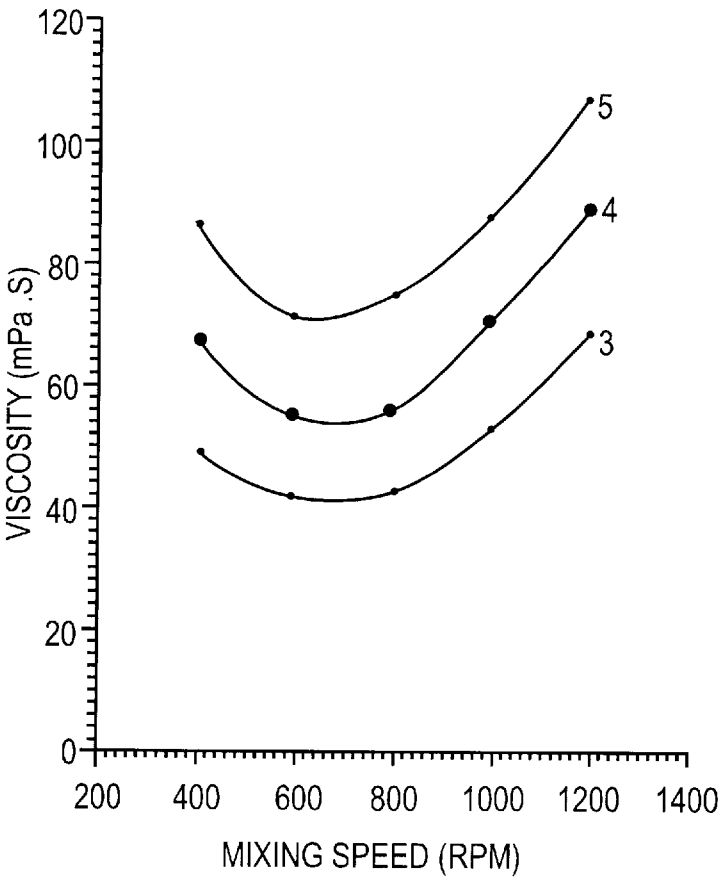
FIG. 11 illustrates the effect of mixing speed on the viscosity of oil-in-water emulsions using various emulsifiers.

The obtained data are presented in FIG. 11 and illustrate that a stirring speed of about 600 rpm results in optimum viscosity reduction of the emulsion.

Figure 12:
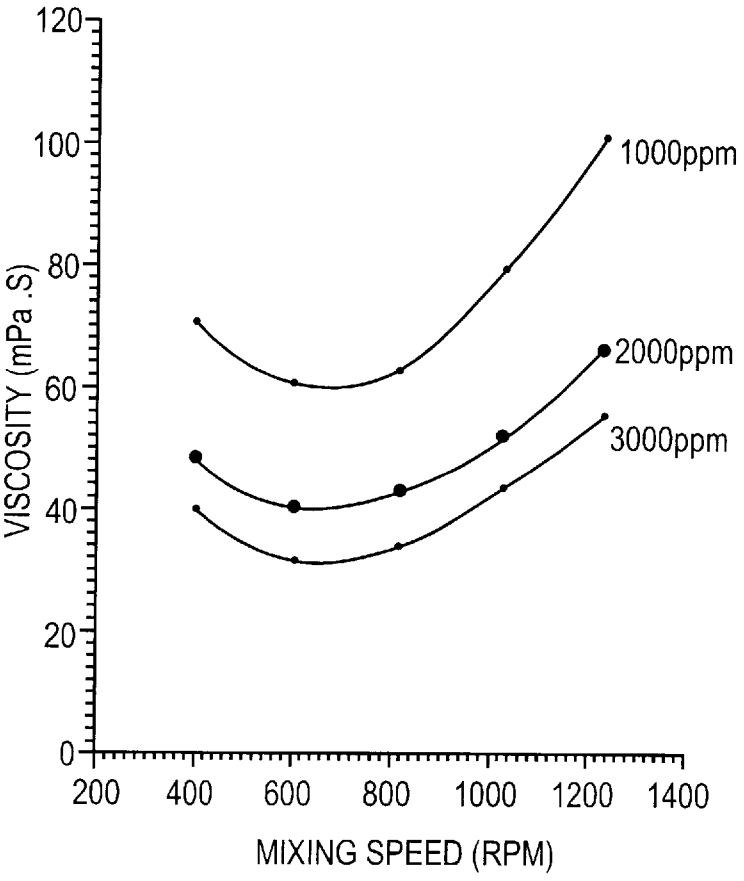
FIG. 12 illustrates the effect of mixing speed on the viscosity of oil-in-water emulsions at various emulsifier concentrations.

Emulsions were also prepared with a nonylphenol ethoxylate emulsifier (HLB=16) at concentrations of 1000, 2000 and 3,000 ppm by volume. The obtained data are presented in FIG. 12. Again, optimum viscosity reduction was achieved at a stirring speed of about 600 rpm independently of emulsifier concentration.

Only a slight reduction in viscosity was obtained when emulsifier concentrations were increased above 2000 ppm. The increase obtained does not appear to justify the cost of additional emulsifier at current prices.

EXAMPLE 9

Effect of Stirring Speed on Emulsion Oil Droplet Size

An emulsion was prepared that was 70% by volume crude oil. The emulsifier used was a nonionic nonylphenol ethyoxylate-type with an HLB value of about 16. The emulsifier concentration was 0.1% (1000 ppm) by volume. The effect of stirring speed on droplet size and distribution is illustrated by the data presented in FIG. 13. The test was conducted at 25° C. (77° F.).

Figure 13:
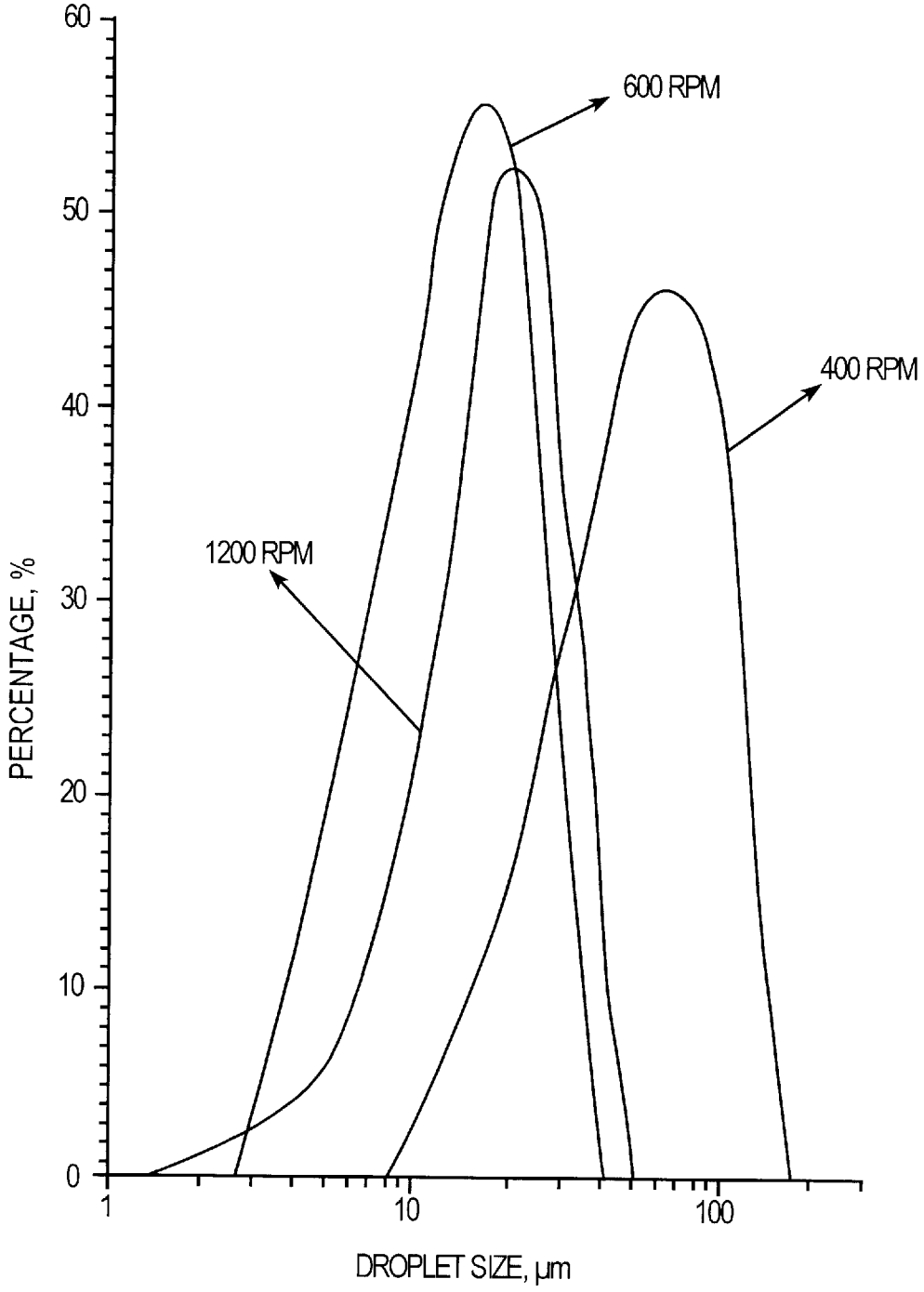
FIG. 13 illustrates the effect of mixing speed on oil droplet size and droplet size distribution in an oil-in-water emulsion.

From the data in FIG. 13 it is readily apparent that a stirring speed of 600 rpm yields a more acceptable mean droplet size and distribution than is obtained at either 400 rpm or 1200 rpm. Though the mean droplet size obtained at 1200 rpm was acceptable, the uniformity of the droplet size was not as good as that obtained at 600 rpm.

EXAMPLE 10

Effect of Stirrer Type on Emulsion Properties

The mechanics of stirring has a large impact on the properties of the emulsion produced thereby. Not only do the impeller design and the speed of rotation of the agitator effect the viscosity and oil droplet size of the oil-in-water emulsion, the tank configuration in conjunction with the agitator design is also significant.

Figure 14:
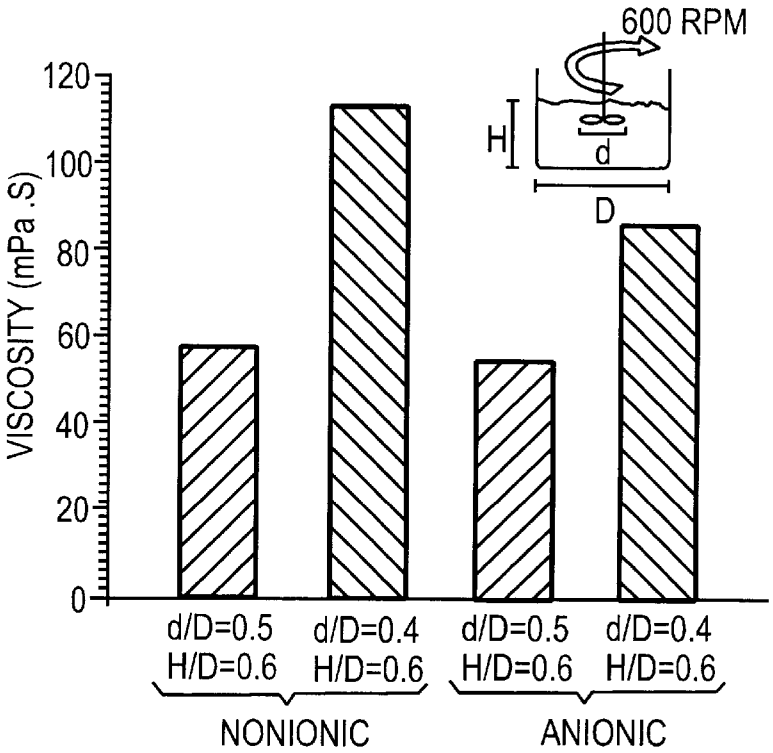
FIG. 14 illustrates the effect of the impeller diameter to tank diameter ratio on the viscosity of emulsions with different emulsifiers.

Emulsions were prepared that were 70% by volume crude in water. A nonionic emulsifier (HLB=16) was used to make one emulsion at a pH of 10 and an anionic emulsifier was use to make another emulsion at a pH of 7. The emulsifier concentrations were 1000 ppm by volume in both instances. Both emulsions were stirred at 600 rpm stirring speed at a temperature of 25° C. (77° F.) under conditions wherein two different ratios of impeller diameter-to-tank diameter were used. When stirred at the higher ratio, both emulsions had a lower viscosity. The observed data are presented in FIG. 14.

Figure 15:
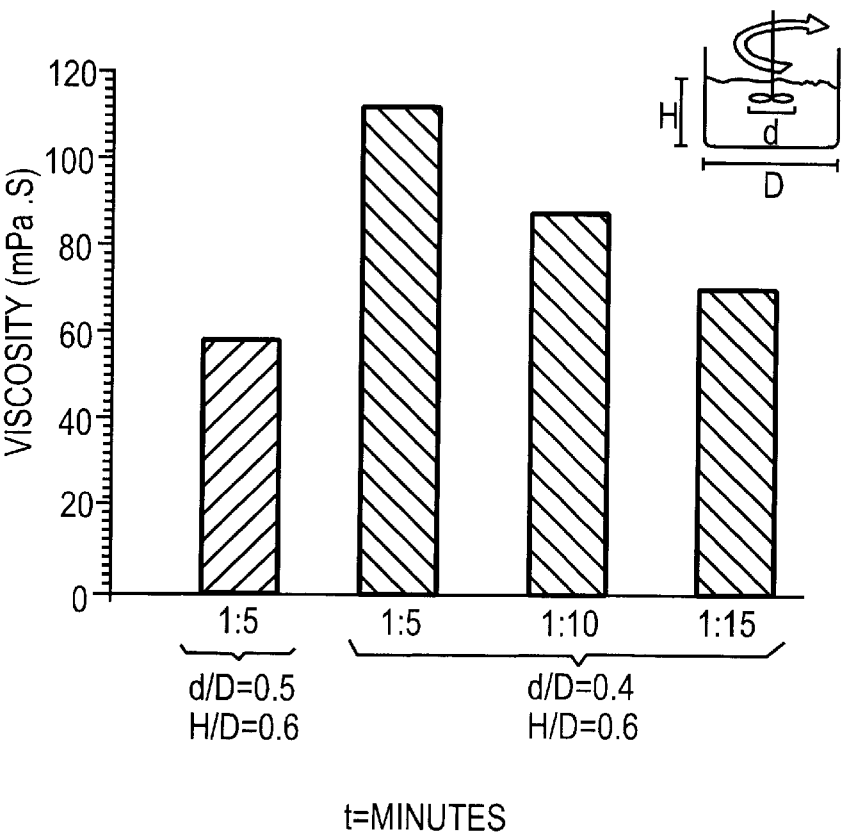
FIG. 15 illustrates the effect of the ratio of impeller diameter to tank diameter on viscosity at different mixing times.

A relatively higher impeller diameter-to-tank diameter ratio can also reduce stirring time. The emulsion with the nonionic emulsifier (HLB=16) was stirred under conditions in which two different impeller diameter-to-tank diameter ratios were used. The observations presented in FIG. 15 clearly illustrate that the emulsion stirred using the relatively higher ratio achieved a lower viscosity in less time.

EXAMPLE 11

Effect of Stirring Time on Emulsion Droplet Size

Figure 16:
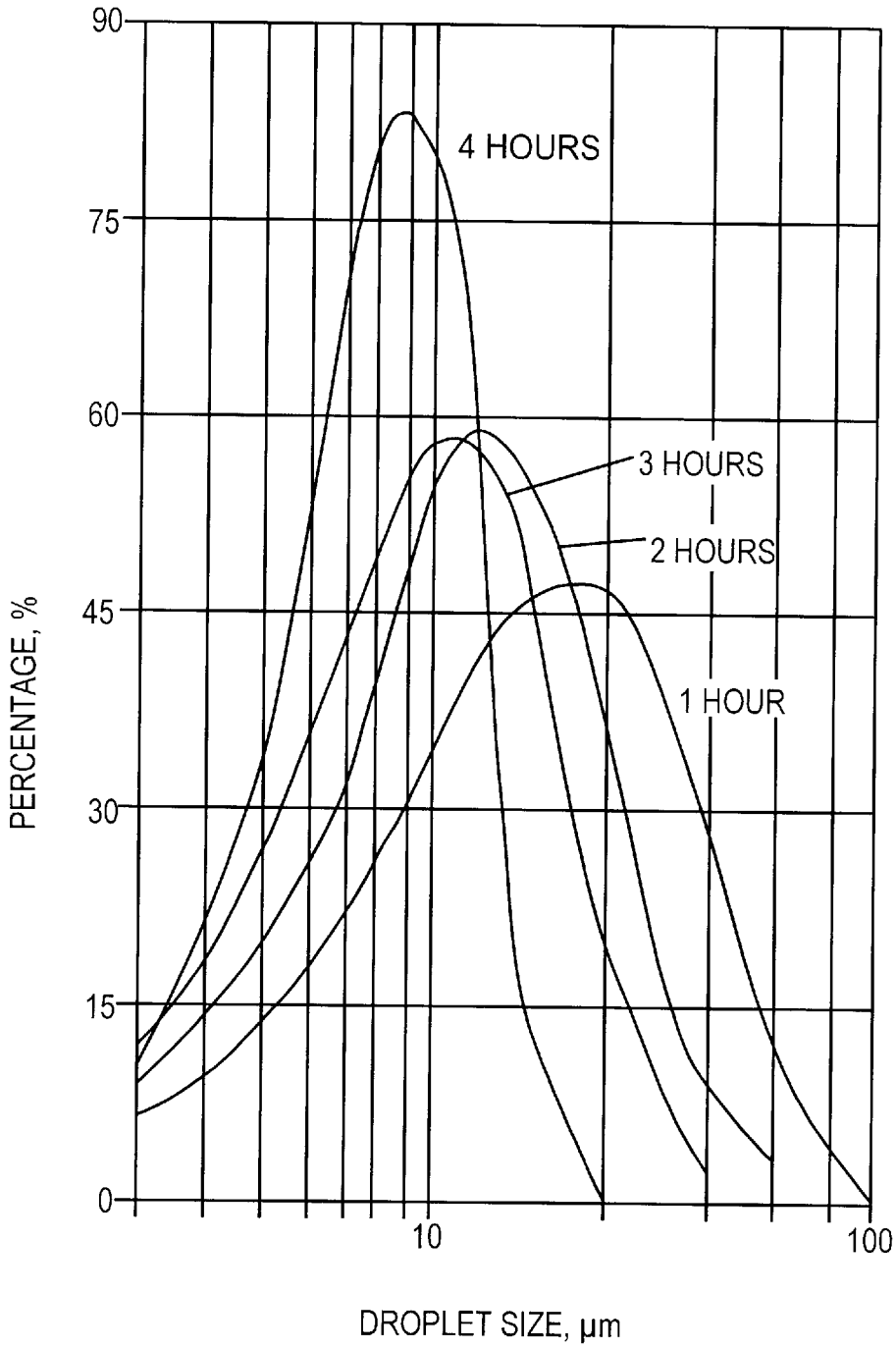
FIG. 16 illustrates the effect of mixing time of droplet size and droplet size distribution.

An oil-in-water emulsion was prepared that was 70% by volume crude oil. An anionic emulsifier was present in the emulsion in a concentration of about 1000 ppm by volume. The temperature of the emulsion was 25° C. (77° F.). The emulsion, total volume of 300 liters, was stirred at a speed of 600 rpm using a propeller type mixer. The effect of the stirring time on the mean oil droplet size and droplet size distribution in the emulsion was noted, and is presented in FIG. 16. The data in FIG. 16 shows that the mean droplet size decreases and the droplet size distribution narrows the longer the emulsion is stirred. The droplet size was measured in a Malvern Series 2600c Droplet and Particle Sizer. The mean droplet size refers to the Sauter mean diameter (SMD) thereof, i.e. the diameter of a droplet whose surface-to-volume ratio is equal to the combined surface-to-volume ratio of all of the oil particles in the emulsion.

EXAMPLE 12

Effect of Time and Temperature on Emulsion Stability

Oil-in-water emulsions have to be separated, i.e., broken down, into oil and water phases, depending upon the end use of the emulsion. For example, if the oil in the emulsion is to be refined, the water phase must be separated from the oil phase prior to refining. If the oil is to be direct fired, however, the emulsion does not have to be broken down prior to use. However, the emulsion should not break down over time or during transport. Prior art emulsions are at times difficult to separate or break, primarily because of the small or irregular droplet size of oil in the water. The relatively high surface area-to-volume ratio of the oil droplets makes it more difficult to separate the emulsion. At other times, prior art emulsions break down too easily, and the transport properties of the emulsion, i.e. reduced viscosity, are lost.

Figure 17:
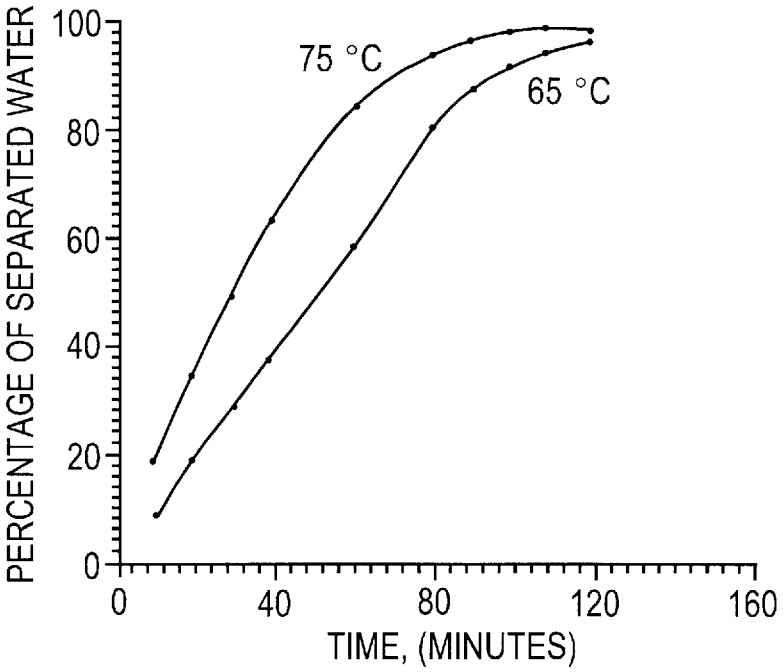
FIG. 17 illustrates the effect of temperature on emulsion stability.
Figure 18:
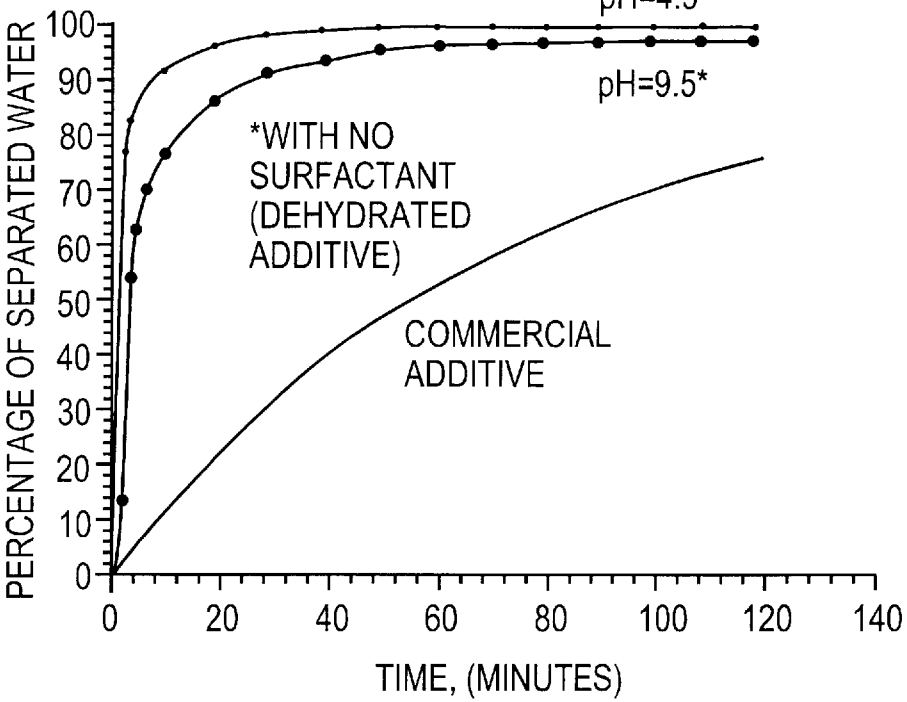
FIG. 18 illustrates the effect of pH on emulsion stability over time.

FIGS. 17 and 18 present data obtained when the present emulsions (O/W: 70/30) are broken, and illustrate that the emulsions disclosed herein were easily broken by temperature or by adding a chemical additive. FIG. 17 clearly illustrates that phase separation is achieved more quickly at a relatively higher temperature. Similar results have been obtained with O/W: 75/25.

FIG. 18 illustrates the rate at which the emulsion breaks down when no emulsifier is present therein. At a pH of 4.5 more than 90 wt-% of the water had separated from the oil within 20 minutes. The broken emulsion ultimately produced substantially clear water and a substantially water-free viscous hydrocarbon with less than 0.5% by volume water therein. A demulsifying agent effected separation of an oil-in-water emulsion with an emulsifier therein at a concentration of 20 ppm by volume, but over a greater period of time. The demulsifying agent used was a nonionic emulsion breaker, alkyl aryl polyether alcohol with an HLB value of 10.

EXAMPLE 13

Effect of Transport on Emulsion Viscosity

Figure 19:
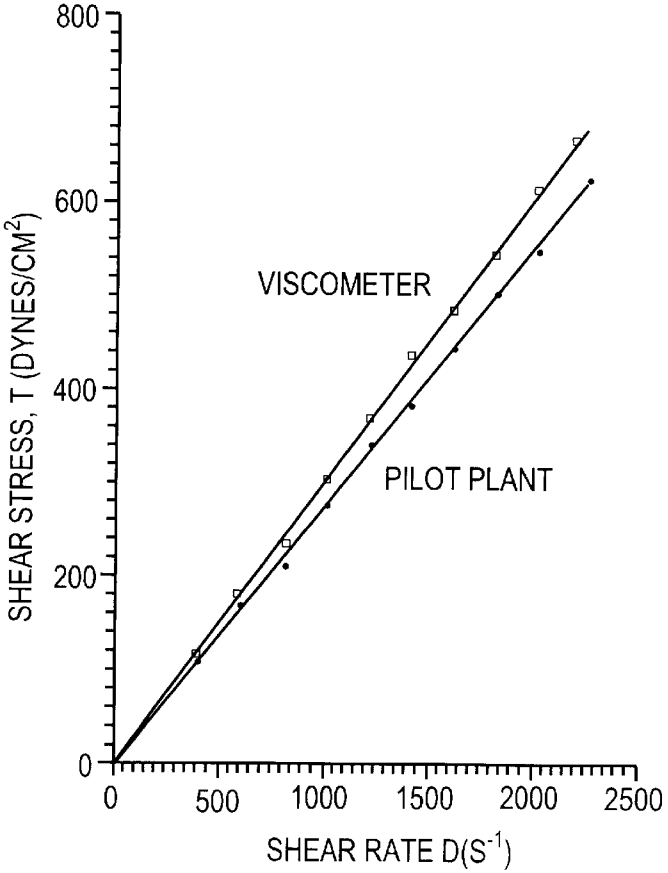
FIG. 19 illustrates the Theological behavior of the emulsion calculated from pilot plant flow data as compared to direct measurements using a concentric viscometer.

The emulsion was evaluated to determine the effect of transportation through a pipeline thereon. The emulsion tested was a 70/30 oil-in-water emulsion made with an anionic, dioctyl sodium sulfosuccinate emulsifier present in a concentration of 1000 ppm (0.1%) by volume. The temperature of the emulsion was 25° C. (77° F.). Pumping the emulsion through the pipeline was accomplished using centrifuges and gear pumps through test loops of pipe that were 36 feet in length and of varying diameters (e.g., 1 inch, ½ inch, ¼ inch, etc.). The emulsion was pumped in the loop from a tank therein for 3 days. FIG. 19 illustrates a proportional relationship between shear stress and shear rate, which is a characteristic of Newtonian behavior.

FIG. 19 also illustrates that the change in shear rate vs. shear stress for the emulsion is similar whether the emulsion rheology is evaluated using flow data from a pilot plant pipeline or from data obtained using a concentric viscometer in the laboratory. This indicates that the viscometer is a fairly accurate representation of actual pumping conditions, and also that the present emulsification process can be scaled up readily. It has also been observed that the emulsion viscosity remained substantially constant as the flow rate was increased.

Figure 20:
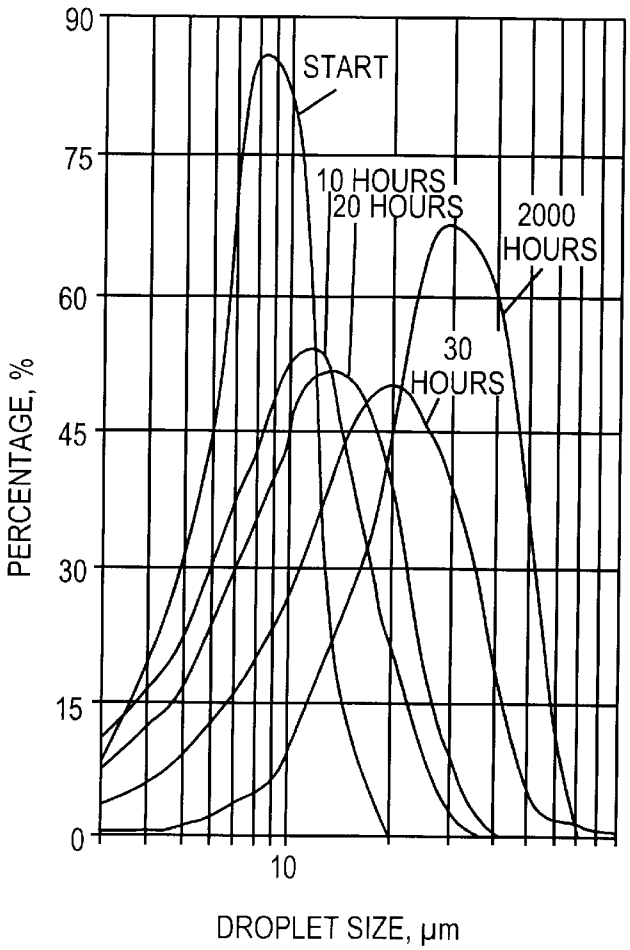
FIG. 20 illustrates the effect of pumping time on droplet size and droplet size distribution.

FIG. 20 presents in graphical form the observed droplet size increase over time during pumping. The droplet size was measured in the same manner as the previous example. While the droplet size increased somewhat, this increase was not significant. The data shown in FIG. 20 demonstrates the overall good stability of the present emulsions.

EXAMPLE 14

Direct Combustion of the Emulsion

Though the emulsion is readily separated into oil and water components, in some instance it is desirable to combust the emulsion without breaking it down. A Castilla heavy crude 75/25 oil-in-water emulsion prepared in accordance with this invention using about 1,000 ppm of sodium alkylbenzene sulfonates was burned in a conventional, induced draft, air cooled combustion chamber equipped for firing diesel fuel at a rate of 1.5 MBtu/h. The O/W emulsion was burned and its combustion was compared to diesel fuel and heavy Castilla crude oil. The viscosity of the three fuels was 90, 12 and 7500 cPs, respectively. The emulsion was ignited readily. There was no appreciable difference in appearance between the emulsion flame and the diesel fuel flame. The flame temperature of the diesel fuel flame was 1000° C. (1832° F.) while the emulsion flame temperature was 900° C. (1652° F.). This however, is not viewed as a disadvantage as relatively lower flame temperatures decrease the formation of nitrogen oxides.

EXAMPLE 15

Emulsion Droplet Size and Droplet Size Distribution

Figure 21:
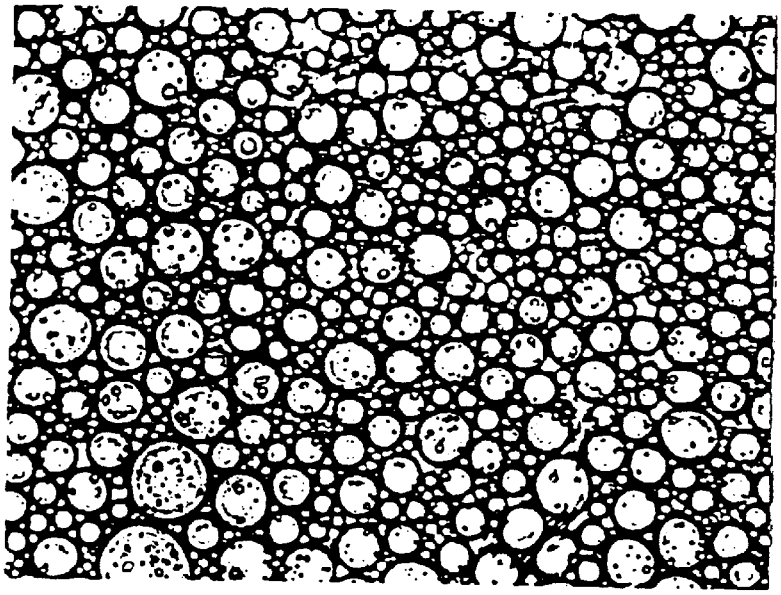
FIG. 21 is a photomicrograph of an oil-in-water emulsion made according to the present invention at 300× magnification.
Figure 22:
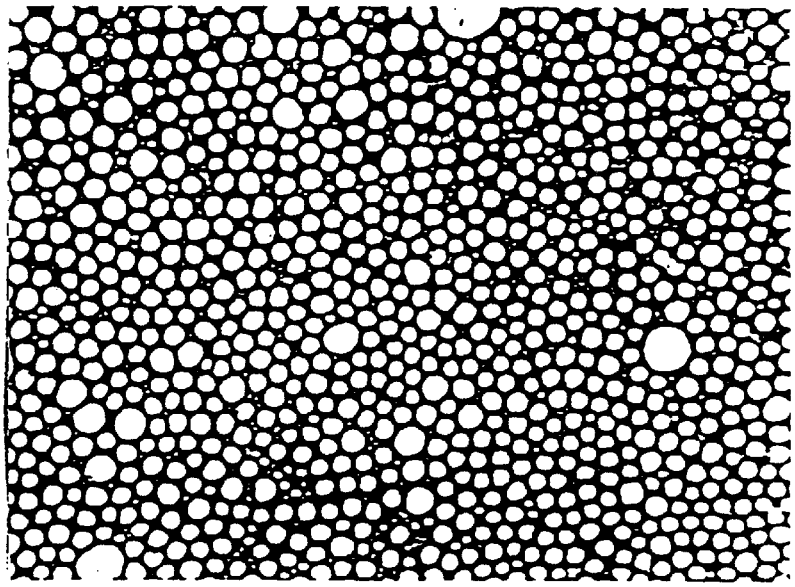
FIG. 22 is a photomicrograph of another emulsion made according to the present invention at 160× magnification.

FIG. 21 and FIG. 22 are photomicrographs of emulsions made according to the present process. Specifically, the emulsion shown in FIG. 21 (300×) was prepared using a propeller-type agitator (600 RPM; shear rate 10 $sec^{-1}$) and about 2,000 ppm (by volume) of dioctyl sodium sulfosuccinate as the emulsifier (anionic). The produced oil-in-water emulsion O/W: 65/35 was observed to have a mean droplet size of about 17.9 μm, a maximum droplet size of about 37.6 μm, and a minimum droplet size of about 1.9 μm. Emulsion viscosity was observed to be about 45 cP (25° C.), and the emulsion exhibited a sigma (σ) value of about 1.2.

The illustrative emulsion embodying the present invention and shown in FIG. 22 (160×) was prepared using a propeller-type agitator (600 RPM; shear rate 10 $sec^{-1}$) and about 1,500 ppm (by volume of dioctyl sodium sulfosuccinate as the emulsifier (anionic) for the Castilla crude oil. The produced oil-in-water emulsion (O/W: 70/30) was observed to have a mean droplet size of about 17.5 μm, a maximum droplet size of about 25.6 μm, and a minimum droplet size of about 1.9 μm. Emulsion viscosity was observed to be about 50 cP (25° C.), and the emulsion exhibited a sigma (σ) value of about 1.1.

Figure 23:
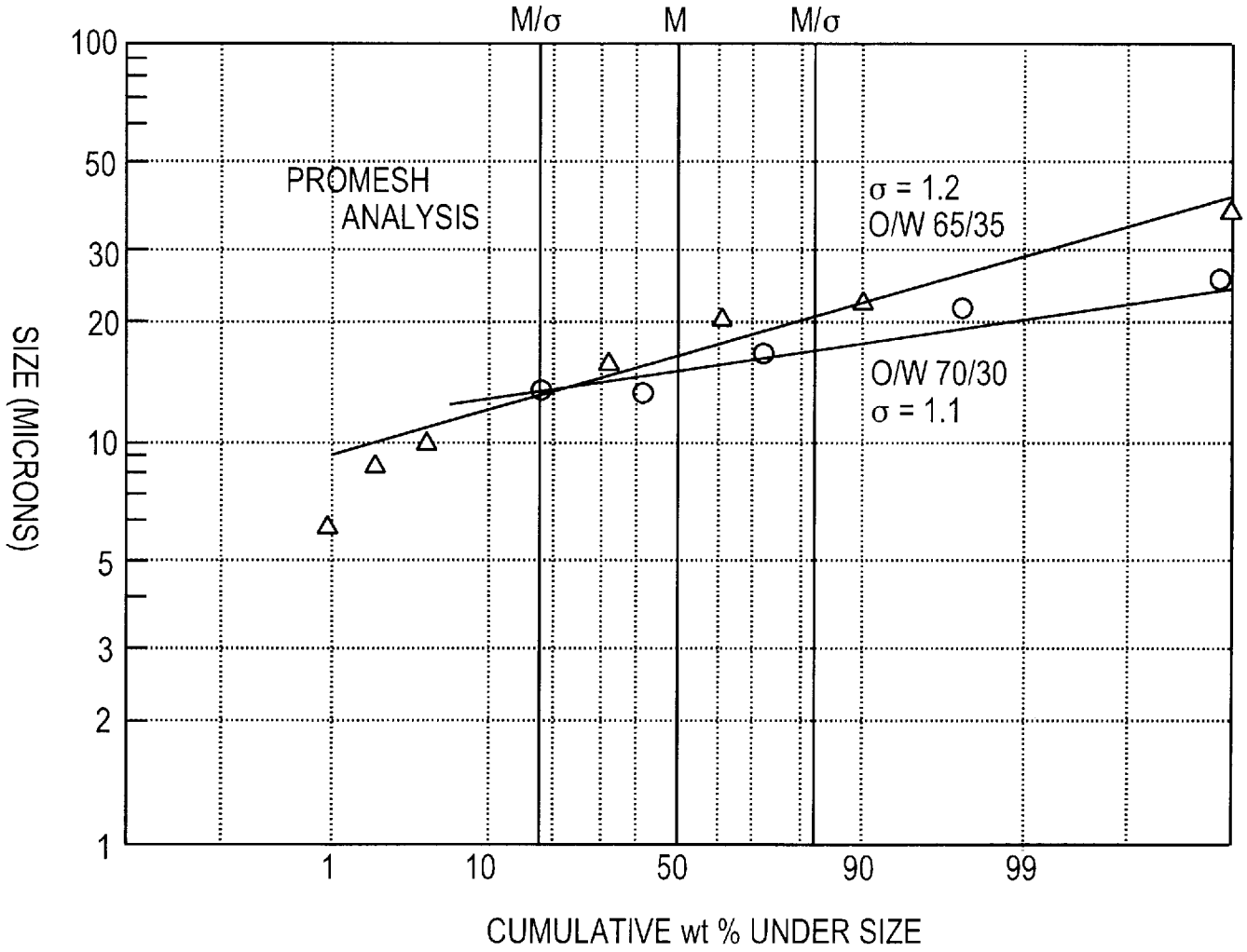
FIG. 23 is a graphical representation of the particle sizes and particle size distributions of the emulsions shown in FIGS. 21 and 22.

The substantially uniform droplet size as well as the droplet size distribution of the emulsions shown in FIGS. 21 and 22 can be readily seen from the graph presented as FIG. 23.

Figure 24:
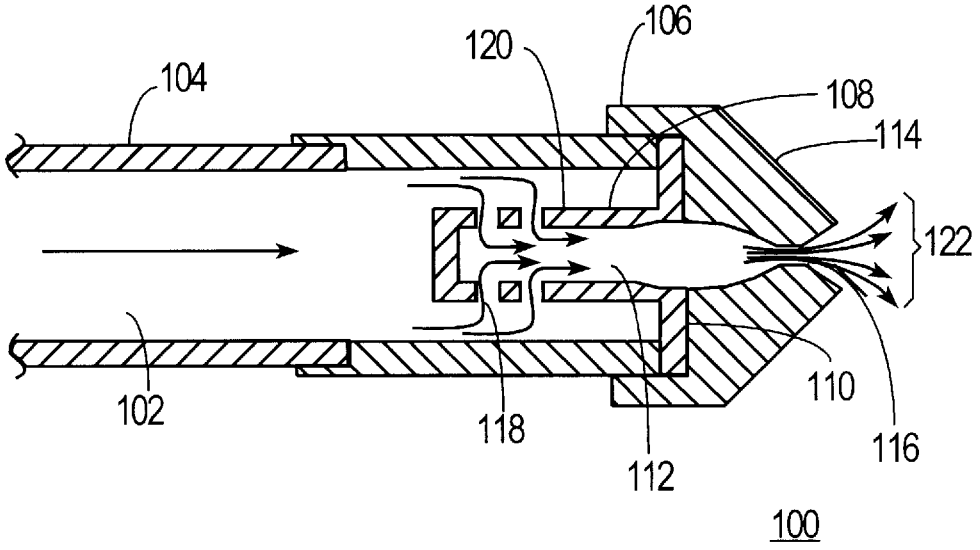
FIG. 24 is a cross-sectional view of a nozzle system diffuser according to one embodiment of the subject invention.

FIG. 24 is a cross-section illustration of a device according to one embodiment of this invention for producing the droplets having substantially uniform size, that is, atomizing the heavy crude oil or emulsion. This embodiment employs a nozzle system 100 as part of the emulsion production. In operation, crude oil 102, or emulsions thereof, travels down a pipe 104 into a nozzle attachment 106 which is attached at the end of the pipe 104. The nozzle attachment 106 contains a cylindrical guard 108 with an outer sleeve 110 at one end for termination and to form a chamber 112. The guard 108 forms the main part of the chamber 112 and the end of the chamber 112 is formed by a nozzle cap 114 which has a decreasing internal radius from one end toward the other end which includes an exit port 116. An increasing internal radius is formed after the exit port 116. The crude oil 102 flows into the chamber through passages 118 formed in the sidewall 120 of the guard 108. This nozzle system 100 causes the crude oil 102 to be emitted from the exit port 116 as a fan spray 122 of droplets, the droplets having substantially uniform size. The flow of the crude oil 102 through the passages 118 and out through exit port 116 causes the droplets to elongate in such a way that forces of cohesion and adhesion produce droplets of substantially uniform size in the tank into which the droplets are sprayed. Although the diffuser is discussed above as diffusing crude oil, the diffuser of this invention is also used with various mixtures and emulsions including heavy crude and/or other types of oil. Thus, for example, references to crude oil should be read to include emulsions containing crude oil.

Figure 25:
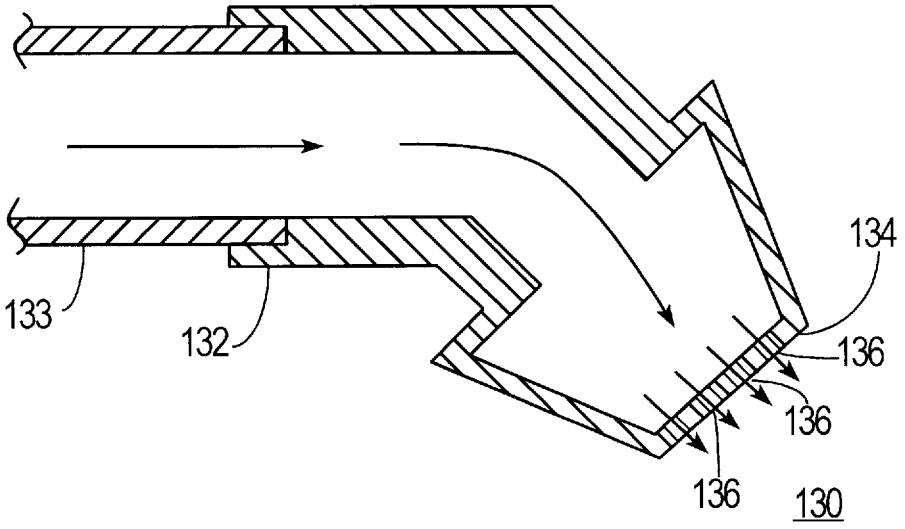
FIG. 25 is a cross-sectional view of a cone-type diffuser according to one embodiment of the subject invention.

Although the nozzle system discussed above employs a nozzle, other types of spray producing atomizers can be used. For example, in one embodiment a diffuser 130 is shaped like a shower attachment, see FIG. 25. In this example, instead of a nozzle system, the narrow end 132 of the cone-shaped diffuser 130 is attached to the end of a pipe 133. The other, larger end of the diffuser is terminated by disk 134 having multiple holes 136, each hole having a radius sufficient for elongating the droplets such that after ejection through the holes into the tank, the droplets have substantially uniform size.

The examples enumerated hereinabove and the accompanying discussion are intended to illustrate the general principles that are applicant's invention. Nothing in the specification or examples is to be construed as a limitation of the invention as defined by the claims.

We claim:

1. A method for the preparation of an oil-in-water emulsion comprising the steps of:

combining about 60% to about 85% by volume of a hydrocarbon having a specific gravity of about 5 degrees to about 30 degrees API, in about 15% to about 40% by volume of an aqueous solution to form an aqueous hydrocarbon mixture, the aqueous solution comprising water and an emulsifier having a hydrophilic-lipophilic balance (HLB) value of about 13.5 to about 16, the emulsifier comprising an anionic emulsifier and a non-ionic emulsifier; and dispersing the hydrocarbon in the aqueous solution of the aqueous hydrocarbon mixture using agitation at a rate of speed of about 50 to about 2,000 revolutions per minute and a shear rate of about 0.1 to about 20 $second^{-1}$ at a power input of about 0.1 to about 0.75 horsepower per 1,000 barrels of the aqueous hydrocarbon mixture for a period of time sufficient to produce an oil-in-water emulsion having a viscosity in the range of 5 to 50 centipoise at 38° C. (100° F.) and stable uniform droplet sizes in the range of 15 to 40 micrometers.

2. The method of claim 1, further comprising, before the combining step, the step of:

mixing about 80% to about 99% heavy crude oil or residuals in a temperature range of 100 degrees and 335 degrees Fahrenheit, and about 20% to about 1% of lighter crude oil or diluent to form the hydrocarbon having a viscosity of about 200,000 centipoise.

3. The method of claim 1, wherein the combining step comprises the step of:

diffusing the hydrocarbon into the aqueous solution.

4. The method of claim 1, wherein the agitating step is continued until at least 95% by volume of the oil-in-water emulsion has an oil droplet size of no more than 40 micrometers.

5. The method of claim 1, wherein the agitating step is performed on line using static mixers.

6. The method of claim 1, wherein the anionic emulsifier has a concentration of about 200 to about 10,000 part per million by volume of the oil-in-water emulsion.

7. The method of claim 1, wherein the non-ionic emulsifier has in a concentration of about 500 to about 5,000 parts per million by volume of the oil-in-water emulsion.

8. The method of claim 1, wherein the aqueous solution further comprises a stabilizing agent.

9. The method of claim 1, wherein the emulsifier is selected from the group consisting of:

a nonylphenol exthoxylate having an hydrophilic-lipophilic balance (HLB) value of about 16 and comprising 20 ethylene oxide units per molecule, an octylphenol ethoxylate having an hydrophilic-lipophilic balance (HLB) value greater than 13.5, a nonylphenol exthoxylate having a hydrophilic-lipophilic balance (HLB) value greater than 13, and a dioctyl sulfosuccinate having a hydrophilic-lipophilic balance (HLB) value greater than about 13.

10. The method of claim 1, further comprising one or more steps of:

adding a stabilizer to maintain a pH value in the range of about 4 to about 13, the stabilizer selected from the group consisting of:

alkali metal hydroxide, hydrochloric acid and alkaline earth metal hydroxide.

11. The method of claim 1, wherein the agitating step is performed with a blade-type impeller.

12. The method of claim 3, wherein the diffusing step is performed with an atomizer device driven by air impulses.

13. The method of claim 2, wherein the light crude oil has a specific gravity of 18.5 degrees API.

14. An emulsion suitable for transport through a pipeline comprising:

about 60% to about 85% by volume of a crude oil having a specific gravity from about 5 degrees to about 30 degrees API; and about 40% to about 15% by volume of an aqueous solution comprising water and an emulsifier having a hydrophilic-lipophilic balance (HLB) value of about 13.5 to about 16, the emulsifier comprising anionic and non-ionic emulsifiers having a concentration from about 200 to about 10,000 parts per million by volume of the oil-in-water emulsion;

such that the viscosity is in the range from about 5 to 350 centipoise at a temperature of 100 degrees Fahrenheit; and wherein the droplet size is substantially uniform and is no greater than about 20 micrometers when transport begins and no greater than about 70 micrometers up to 2000 hours later.

15. The emulsion of claim 14, wherein the non-ionic emulsifier has a concentration from about 500 to 5,000 parts per million.

16. The emulsion of claim 14, wherein the anionic emulsifier has a concentration from about 200 to 10,000 parts per million.

17. The emulsion of claim 14, wherein the emulsion further comprises a stabilizing agent.

18. The emulsion of claim 14, wherein the emulsion has a dynamic viscosity at ambient temperature of no more than about 50 Pa.s.

19. The emulsion of claim 14, wherein a particle size distribution in the emulsion has a sigma value of less than about 1.1.

20. A method of producing energy at a remote location comprising the steps of:

diffusing a hydrocarbon into an aqueous solution;

dispersing the hydrocarbon in the aqueous solution to produce an emulsion having a viscosity in the range from about 5 to 350 centipoise at a temperature of 100 degrees Fahrenheit and substantially uniform droplet sizes of no greater than about 40 micrometers, the emulsion comprising:

about 60% to about 85% by volume of the hydrocarbon having a specific gravity from about 5 degrees to about 30 degrees API; and about 40% to about 15% by volume of the aqueous solution, the aqueous solution comprising water and an emulsifier having a hydrophilic-lipophilic balance (HLB) value of about 13.5 to about 16, the emulsifier comprising an anionic emulsifier and a non-ionic emulsifier and having a concentration from about 200 to about 10,000 parts per million by volume of the emulsion;

transporting the emulsion through a pipeline to the remote location; and combusting the emulsion at the remote location.

21. A device for forming crude oil droplets of substantially uniform size in an emulsion comprising:

an inlet having at least one receiving passage connected to an end of a pipe;

a main body connected to the receiving passage for receiving crude oil from the pipe; and a terminator connected to the main body having at least one exit passage;

such that oil droplets are elongated by the exit passages so as to form droplets of the substantially uniform size in the emulsion.

22. A device according to claim 21, wherein:

the main body further comprises a chamber having at least one sidewall passage, such that elongated droplets form by flowing into the chamber through the sidewall passages and out of the exit passage.

23. A device according to claim 21, wherein:

the main body has a cone shape; and the terminator forms a disk at the large end of the cone shape.

* * * * *